US009353565B2

(12) United States Patent
Bacchetti

(10) Patent No.: US 9,353,565 B2
(45) Date of Patent: May 31, 2016

(54) SYSTEM FOR CONTROLLABLE ROTATION OF CLOSING ELEMENT

(71) Applicant: Luciano Bacchetti, Nave (IT)

(72) Inventor: Luciano Bacchetti, Nave (IT)

(73) Assignee: IN & TEC S.R.L., Brescia (IT)

( * ) Notice: Subject to any disclaimer, the term of this patent is extended or adjusted under 35 U.S.C. 154(b) by 0 days.

(21) Appl. No.: 14/490,379

(22) Filed: Sep. 18, 2014

(65) Prior Publication Data

US 2015/0121653 A1 May 7, 2015

Related U.S. Application Data

(63) Continuation-in-part of application No. 14/115,868, filed as application No. PCT/IB2012/052504 on May 18, 2012, now Pat. No. 8,863,356.

(51) Int. Cl.
*E05F 3/20* (2006.01)
*E05F 3/10* (2006.01)
*E05F 3/12* (2006.01)

(52) U.S. Cl.
CPC . *E05F 3/20* (2013.01); *E05F 3/104* (2013.01); *E05F 3/12* (2013.01); *Y10T 16/2771* (2015.01); *Y10T 16/2774* (2015.01)

(58) Field of Classification Search
CPC ..... E05F 3/04; E05F 3/06; E05F 3/10; E05F 3/104; E05F 3/12; E05F 3/20; Y10T 16/2771; Y10T 16/2774; Y10T 16/304; Y10T 16/283; Y10T 16/53822; Y10T 16/53826; Y10T 16/534; Y10T 16/5345
See application file for complete search history.

(56) References Cited

U.S. PATENT DOCUMENTS 366,711 A * 7/1887 Bardsley ..... E05F 3/104 16/51
1,214,748 A * 2/1917 Brand ..... E05F 1/1223 16/284
2,035,144 A * 3/1936 Cerami ..... E05D 3/02 16/280
2,588,010 A * 3/1952 Kennon ..... E05F 3/104 16/239
2,603,818 A * 7/1952 Carlson ..... E05F 3/10 16/229
3,437,059 A * 4/1969 James ..... E06B 9/01 108/151
3,449,789 A * 6/1969 Russell ..... E05F 3/104 16/49
3,474,485 A * 10/1969 Mittig ..... E05F 3/104 16/55
6,560,821 B2 * 5/2003 Miller ..... E05D 5/0246 16/252
6,704,966 B1 * 3/2004 Kao ..... E05D 5/0246 16/252
7,305,796 B2 * 12/2007 Chiang ..... E05D 5/0246 16/252
7,552,509 B2 * 6/2009 Chen ..... E05F 5/10 16/286
7,900,319 B2 * 3/2011 Bacchetti ..... E05D 5/0246 16/252
8,191,206 B1 * 6/2012 Bacchetti ..... E05D 11/1014 16/378
8,443,487 B2 * 5/2013 Bacchetti ..... E05F 3/104 16/252
8,572,807 B2 * 11/2013 Walhorn ..... E05D 5/0246 16/235
8,601,644 B1 * 12/2013 Chen ..... E05F 5/006 16/286

(Continued)

*Primary Examiner* — Jeffrey O Brien
(74) *Attorney, Agent, or Firm* — Themis Law

(57) ABSTRACT

A system for controlled rotatable movement of a closing element anchored to a stationary support structure includes a piston device and a hinge device. The hinge device has a fixed element and a movable element reciprocally coupled to allow mutual rotation, a seat for removably inserting the piston device, and a pivot member with a cam element facing the seat to interact with the piston device. The piston device includes a tubular body, an actuating head external to the tubular body, a plunger member slidable within the tubular body, and an elastic contrast member acting on the plunger member for returning it from a retracted end position to an extended end position. The seat of the hinge body includes a pass-through or blind bore extending along an axis for providing access into the hinge body in a direction substantially parallel to or coinciding with the axis.

20 Claims, 21 Drawing Sheets

(56) References Cited

U.S. PATENT DOCUMENTS

| | | | | |
|---|---|---|---|---|
| 8,677,560 | B2 * | 3/2014 | Bacchetti | E05F 3/104 16/252 |
| 8,720,005 | B2 * | 5/2014 | Cheng | E05D 5/0246 16/252 |
| 8,863,356 | B2 * | 10/2014 | Bacchetti | E05F 3/104 16/252 |
| 2007/0246945 | A1 * | 10/2007 | Chiang | E05D 5/0246 292/92 |
| 2010/0024159 | A1 * | 2/2010 | Oh | E05D 5/0246 16/54 |
| 2010/0199459 | A1 * | 8/2010 | Bacchetti | E05D 5/0246 16/54 |
| 2011/0219583 | A1 * | 9/2011 | Bacchetti | E05D 11/1014 16/54 |
| 2011/0283478 | A1 * | 11/2011 | Berry | E05F 5/02 16/54 |
| 2012/0216370 | A1 * | 8/2012 | Chow | E05D 5/0246 16/54 |
| 2013/0160238 | A1 * | 6/2013 | Cheng | E05F 3/04 16/54 |
| 2013/0185896 | A1 * | 7/2013 | Yu | E05F 3/104 16/55 |
| 2014/0352108 | A1 * | 12/2014 | Cheng | E05F 3/104 16/54 |

* cited by examiner

H
Vb
F
P
W
M
B
Vb
Y
D

H
F
P
W
45
B
17
M
34
33
31'
18
32
15
31"
35
D
16
50
Y

F
50
18
34
15
43
45
V
Y
Vc
Vc
M
35
B
16
T
17
X

SYSTEM FOR CONTROLLABLE ROTATION OF CLOSING ELEMENT

FIELD OF INVENTION

The present invention is generally applicable to the technical field of closing or damping hinges, and particularly relates to a piston and hinge device system for the controlled rotatable movement of a closing element, such as a door, a shutter or the like, anchored to a stationary support structure, such as a wall, a frame and/or a floor.

BACKGROUND OF THE INVENTION

As it is known, the closing or damping hinges generally comprise a movable element, usually fixed to a door, a shutter or the like, pivoted on a fix element, usually fixed to the support frame thereof, or to a wall and/or to the floor.

Usually, such hinges comprise a cam element which interacts with a plunger member slidably movable in an operative chamber within the fixed or mobile element.

Moreover, elastic contrast means acting on the plunger member and a working fluid, usually oil, adapted to hydraulically counteract the action thereof are provided, thus controlling the rotation of the door, the shutter or the like.

From international applications WO2007/125524 and WO2011/016000 exemplary embodiments of these hinges are known, which have a pivot defining a substantially vertical axis perpendicular to the horizontal sliding axis of the plunger member.

Although these hinges have high functionality and reliability, they have the recognized drawback that the plunger member is insertable in correspondence of the rear portion of the hinge body, after the making the operating chamber by a difficult deburring machining process and internal thread thereof to allow the screwing of the closure cap.

Such process, long, difficult and hence expensive per se, is even more difficult by the fact that the plunger member moves in an oil bath, so that the machining tolerances must be very low.

In these conditions, it is self-evident that the shape of the hinge body is strongly conditioned by the presence of the closure cap.

Moreover, the materials to be used must be of the best quality, since any maintenance and replacement of the internal mechanical members is extremely difficult and require, in any case, the dismounting of the door, shutter or the like from the hinge device, and of the latter from the support structure to which it is coupled.

Further, the overall dimensions of the hinge device are strongly influenced by the above described processing.

From documents U.S. Pat. No. 2,588,010 and US2010/024159 door closers are known in which the plunger member is mounted in a tubular member fixed to the main body of the same door closer.

These devices have high dimensions, in particular due to the shape of the respective cam elements.

Moreover, in case of maintenance or replacement they require the dismounting of the door, shutter or the like to which they are coupled.

SUMMARY OF THE INVENTION

A main object of the present invention is to overcome at least partly the above mentioned drawbacks, by providing a piston device and/or a hinge device and/or an system thereof of high functionality, simple construction and low cost.

Another object of the invention is to provide a piston device that allows making a hinge device of any external shape.

Another object of the invention is to provide a piston device and/or a hinge device and/or a system thereof having extremely small dimensions.

Another object of the invention is to provide a piston device and/or a hinge device and/or a system thereof which ensures the automatic closing of the door from the open door position.

Another object of the invention is to provide a piston device and/or a hinge device and/or a system thereof which ensures the controlled movement of the door to which it is connected, both during opening and closing.

Another object of the invention is to provide a piston device and/or a hinge device and/or a system thereof which is capable of moving also very heavy doors and windows without changing its behaviour and without the need for adjustments.

Another object of the invention is to provide a piston device and/or a hinge device and/or a system thereof which has a minimum number of constituent parts.

Another object of the invention is to provide a piston device and/or a hinge device and/or a system thereof capable to maintain over time the exact closing position.

Another object of the invention is to provide a piston device and/or a hinge device and/or a system thereof that is safe.

Another object of the invention is to provide a piston device and/or a hinge device and/or a system thereof which is easy to install.

Another object of the invention is to provide a piston device and/or a hinge device and/or a system thereof that simplifies the maintenance and/or replacement operations.

Another object of the invention is to provide a hinge device which allows simple adjustment of the closed position of the door, shutter or the like to which it is connected.

These and other objects, as better explained hereafter, are fulfilled by a system for the controlled rotatable movement of a closing element anchored to a stationary support structure comprising:

a piston device; and a hinge device;

wherein the hinge device includes:

a fixed element anchorable to the stationary support structure; and a movable element anchorable to the closing element;

wherein the movable element and the fixed element are reciprocally coupled to allow the rotation of the movable element between an open position and a closed position, one of the movable element or the fixed element including a hinge body having at least one seat for removably inserting the piston device, the other one of the movable element or the fixed element including a pivot member having a cam element with at least one substantially flat operative surface facing the at least one seat to interact with the piston device; and wherein the piston device includes:

a tubular body removably insertable into the at least one seat of the hinge device having a front portion configured to be faced towards the at least one substantially flat operative surface of the hinge device and a rear portion including a bottom wall, the tubular body including an operating chamber defining a first longitudinal axis;

an actuating head external to the tubular body including a substantially flat front pushing face susceptible to contact engage the at least one substantially flat operative surface of the hinge device; and a plunger member slidably movable in the operating chamber between a retracted end position and an extended end position for separating therein at least one first and one second variable volume compartments in fluid communication with each other;

wherein the actuating head is unitarily connected with the plunger member to move along the first axis between a position proximal to the front portion of the tubular body, corresponding to the retracted end position of the plunger member, and a position distal thereto, corresponding to the extended end position of the plunger member;

wherein the operating chamber further includes an elastic contrast member acting on the plunger member for returning thereof from the retracted end position to the extended end position, the operating chamber further including a working fluid acting on the plunger member to hydraulically counteract an action thereof, the elastic contrast means being configured to move between a position of maximum and minimum elongation respectively corresponding to the distal and proximal positions of the actuating head;

wherein the at least one seat of the hinge body includes a pass-through or blind bore extending along a second axis for providing access into the hinge body in a direction substantially parallel to or coinciding with the first axis, the pivot member of the hinge device having an elongated shape to define a third axis substantially perpendicular to the second axis;

wherein the at least one substantially flat operative surface of the pivot member is substantially parallel to the third axis, the at least one substantially flat operative surface of the pivot member and the substantially flat front pushing face of the actuating head being substantially parallel to each other when the actuating head is in the distal position and substantially perpendicular each other when the same actuating head is in the proximal position.

Conveniently, the hinge device may further comprise an abutment member within the bore adapted to abut against the tubular body of the piston device during insertion thereof in the at least one seat.

Suitably, the abutment member is adapted to abut against the bottom wall of the tubular body of the piston device.

In an embodiment of the system, the bore may be a blind bore which includes an opening facing the pivot member and an end wall opposite thereto. In this case, the abutment member may include the end wall.

In another embodiment of the system, the bore may be a pass-through bore. In this case, the abutment member may be a pin substantially transversely inserted within the bore. Conveniently, the pin may extend along an axis substantially parallel to the axis of the pivot member.

Advantageous embodiments of the invention are defined in accordance with the dependent claims.

BRIEF DESCRIPTION OF THE DRAWINGS

Further features and advantages of the invention will appear more evident upon reading the detailed description of some preferred, non-exclusive embodiments of a piston device and/or a hinge device and/or an system thereof according to the invention, which is described as non-limiting examples with the help of the annexed drawings, in which:

FIGS. 7*a* to 7*f* are axonometric and radially sectioned views of some embodiments of the pivot member V of the hinge device H, wherein FIGS. 7*a* and 7*b* show a first embodiment in which the substantially flat operative surface A lies on the median plane $\pi_M$, FIGS. 7*c* and 7*d* show a second embodiment in which the substantially flat operative surface A is offset with respect to the median plane $\pi_M$ and the edges E are rounded, FIGS. 7*e* and 7*f* show a third embodiment in which the substantially flat operative surface A is offset with respect to the median plane $\pi_M$ and the edges E are tapered;

DETAILED DESCRIPTION OF SOME PREFERRED EMBODIMENTS

With reference to the annexed figures, the piston device 1 is particularly useful for the controlled rotatable movement of a closing element D, such as a door, a shutter or the like, during closing and/or during opening thereof, which closing element may be anchored to a stationary support structure W, such as a wall, a door or window frame and/or a floor.

To this end, the piston device is advantageously to be used with a hinge device H which includes a fix element F anchorable to the stationary support structure W and a movable element M anchorable to the closure element D. As per se known, the fix element F and the movable one M can be mutually coupled to rotate about an axis X, which may be substantially vertical, between an open position and a closed position.

The piston device 1 and the hinge device H may be particularly useful for rotatably moving glass doors.

The annexed figures show various embodiments of the invention. Unless otherwise specified, it is understood that features which are common to several embodiments may be indicated with a single identification mark, whether number or letter.

Figure 3A:
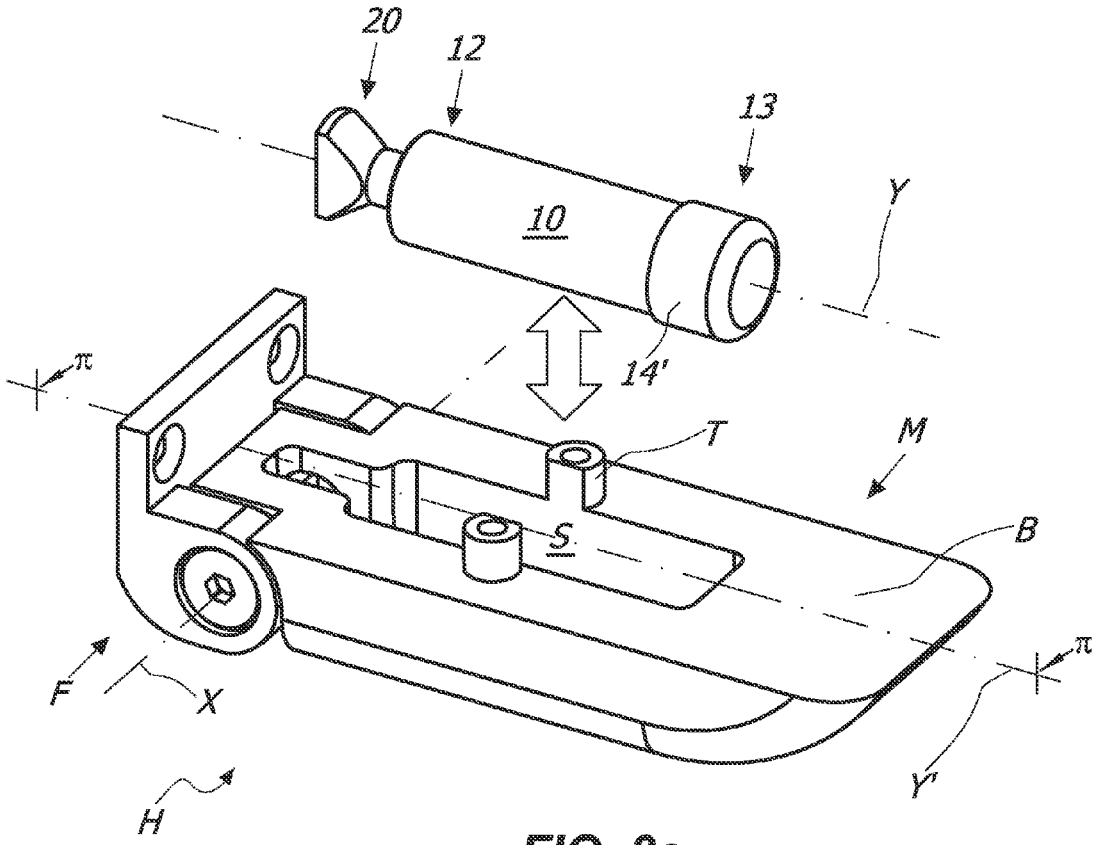
FIGS. 3*a* and 3*b* are respectively axonometric and side views of the piston device 1, respectively before and after the insertion thereof into the seat S of the hinge body B of the hinge device H.
Figure 3B:
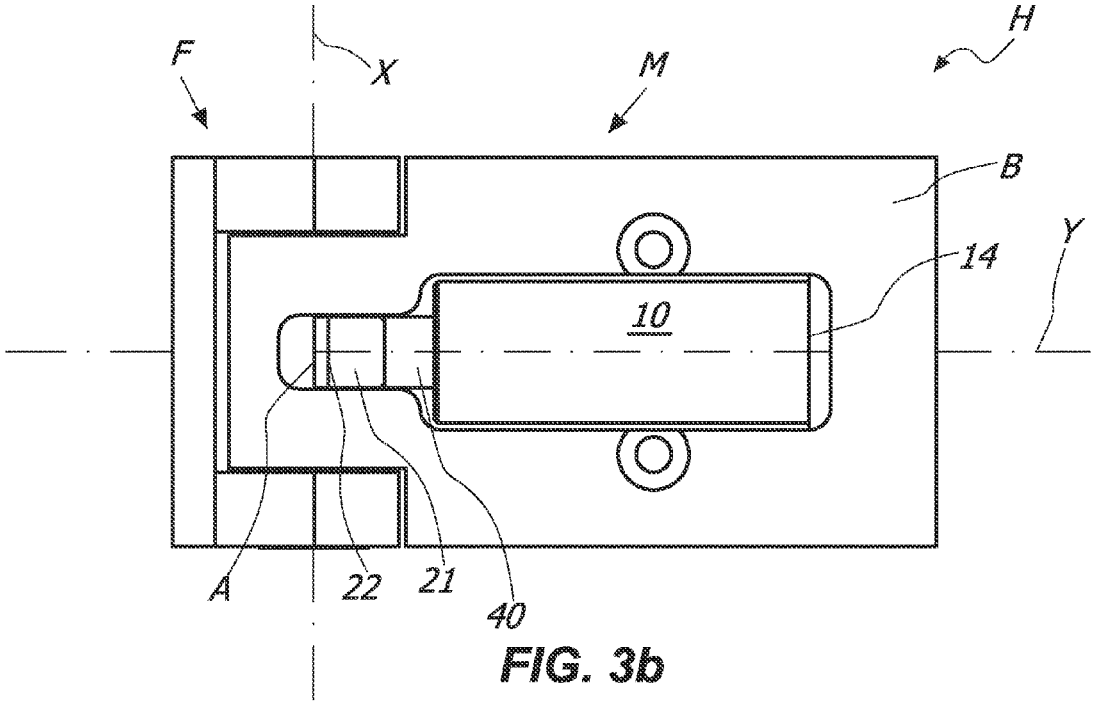

As particularly shown in FIGS. 3*a* and 3*b*, the hinge device H may include a hinge body B with a seat S, which may preferably be countershaped with respect to the piston device 1, so as to allow the removable insertion thereof within the hinge device H and/or the removal therefrom.

Conveniently, the seat S may have an elongated shape to define an axis Y' substantially perpendicular to the axis X.

It is understood that the hinge body B may include one or more seats S each one including a respective piston devices 1 without departing from the scope of protection defined by the appended claims.

The hinge device H may also include a cam element C, facing the seat S to interact with the piston device 1. Moreover, the cam element C may suitably be integrally movable with a pivot member V defining the axis X, and can include a substantially flat operative surface A susceptible to interact with the piston device 1.

Figure 19:
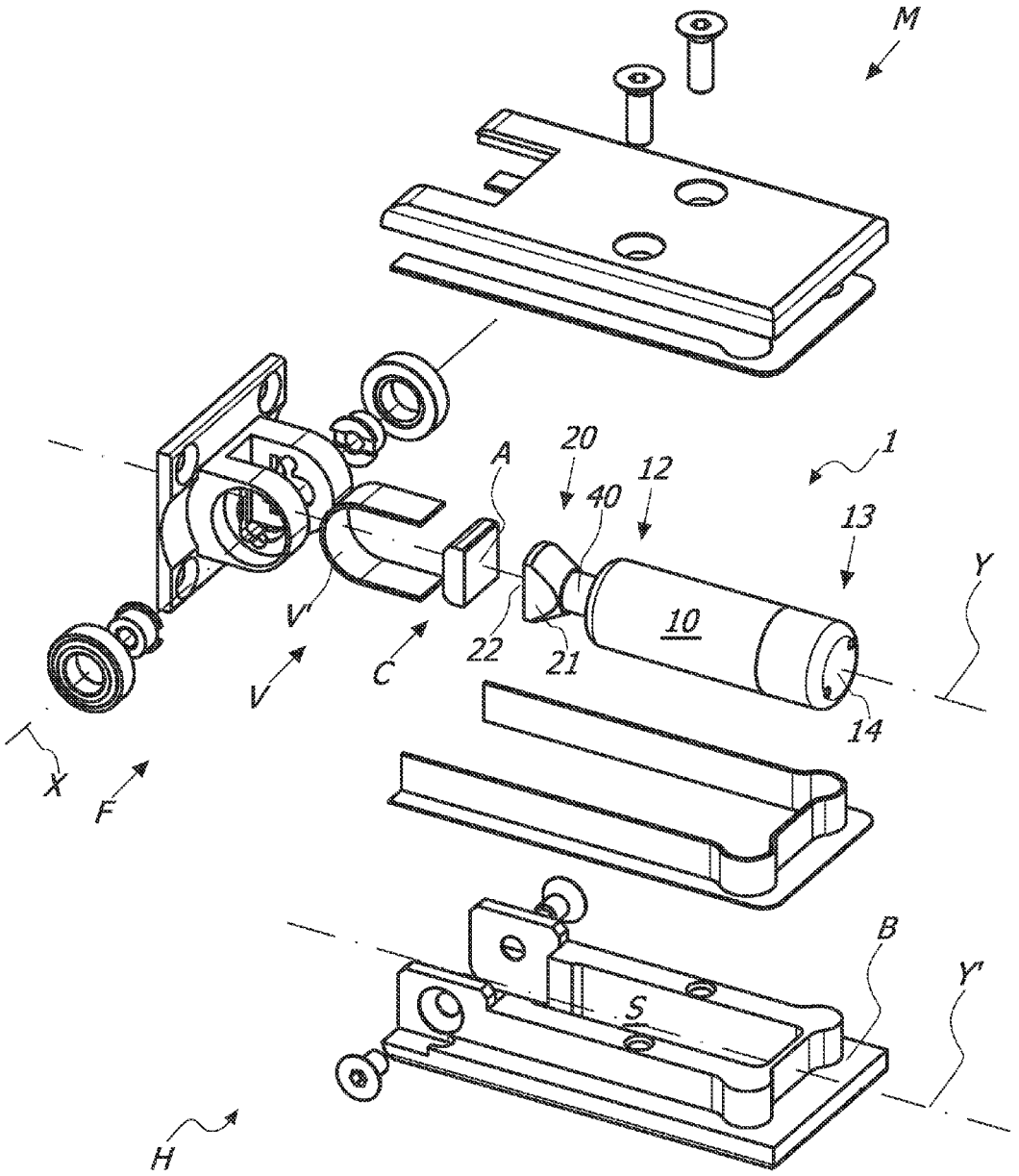
FIG. 19 is an exploded axonometric view of a further embodiment of the hinge device H.

The pivot member V may have any shape. In particular, the cam element C may be made of one piece with the pivot member V, as shown for example in FIGS. 7*a* to 7*f*, or may be unitary connected to a support V', as shown for example in FIG. 19.

Figure 7A:
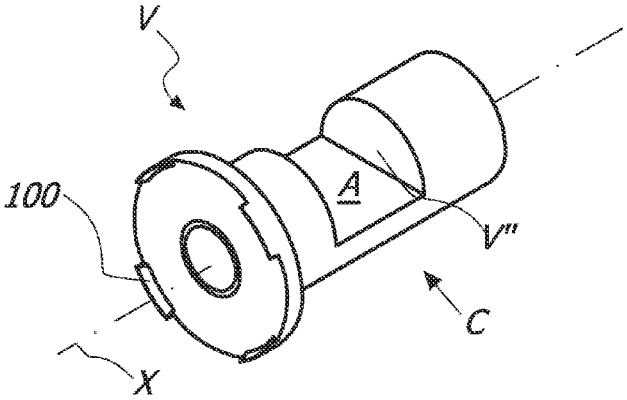
Figure 7B:
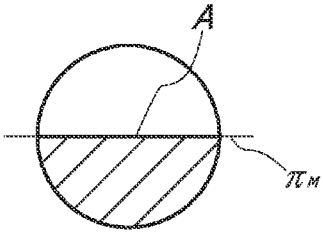

As shown by way of example in FIGS. 7*a* to 7*f*, the substantially flat operative surface A may have any position with respect to the median plane $\pi_M$ passing through the axis X and perpendicular to the axis Y'. In particular, the substantially flat operative surface A may precisely lie on the median plane $\pi_M$, as shown in FIGS. 7*a* and 7*b*, or may be offset with respect to the latter, whether the former surface A is behind the latter plane $\pi_M$, in accordance with the teachings of the international applications WO2007/125524 and WO2011/016000, or above it, as shown in FIGS. from 7*c* to 7*f*.

Figure 7C:
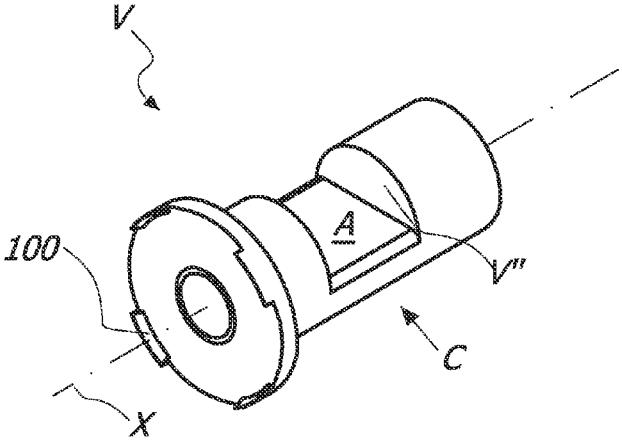
Figure 7D:
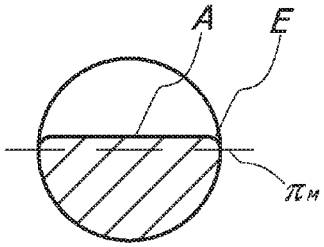
Figure 7E:
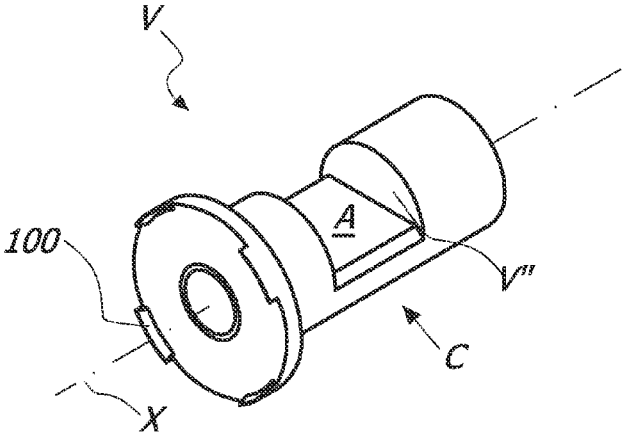
Figure 7F:
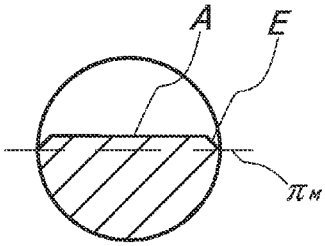
Figure 8A:
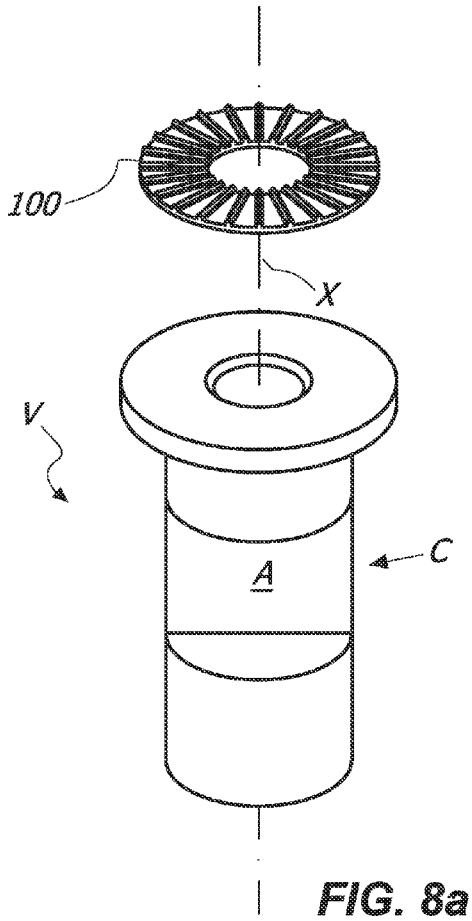
FIGS. 8*a* to 8*c* are axonometric views of further embodiments of the pivot member V of the hinge device H which includes the projections 100.
Figure 8B:
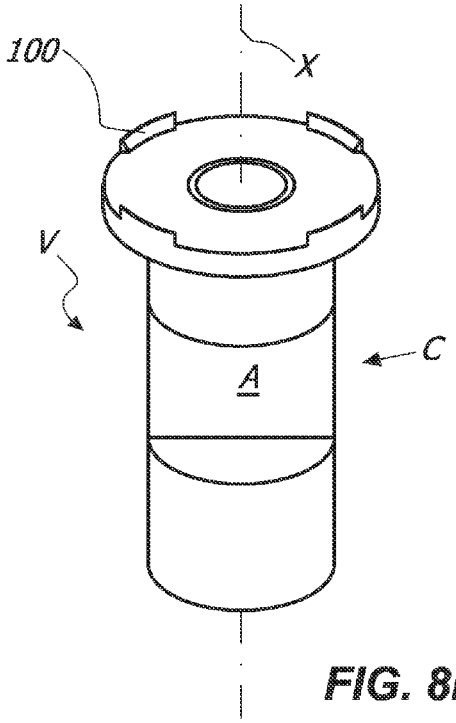
Figure 8C:
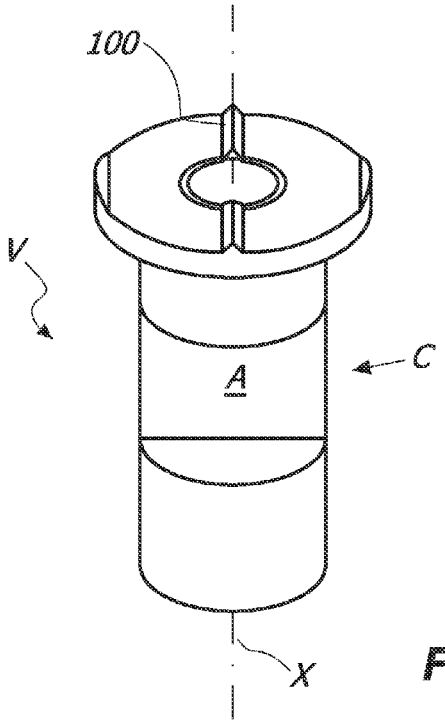
Figure 9A:
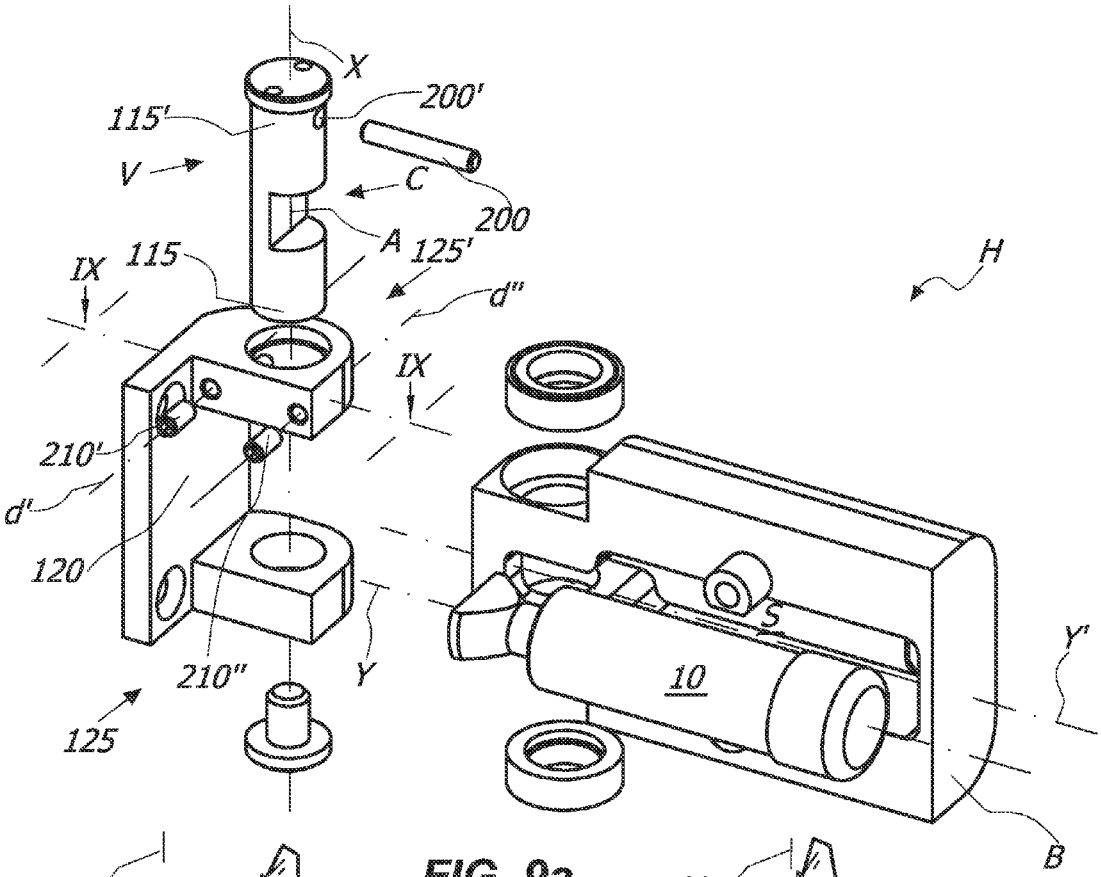
FIGS. 9*a*, 9*b* and 9*c* are respectively sectioned, top and partially sectioned along a plane IX-IX views of a second embodiment of the hinge device H in which the angular position of the substantially flat operative surface A of the cam element C is adjustable.
Figure 9B:
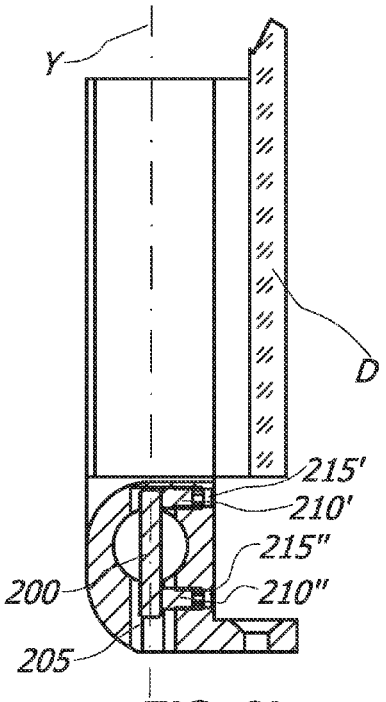
Figure 9C:
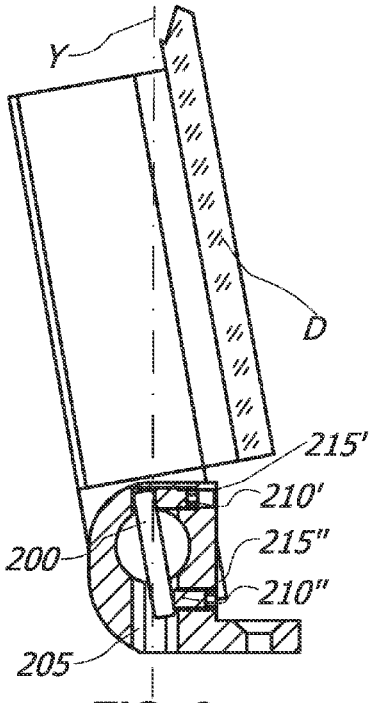
Figure 10A:
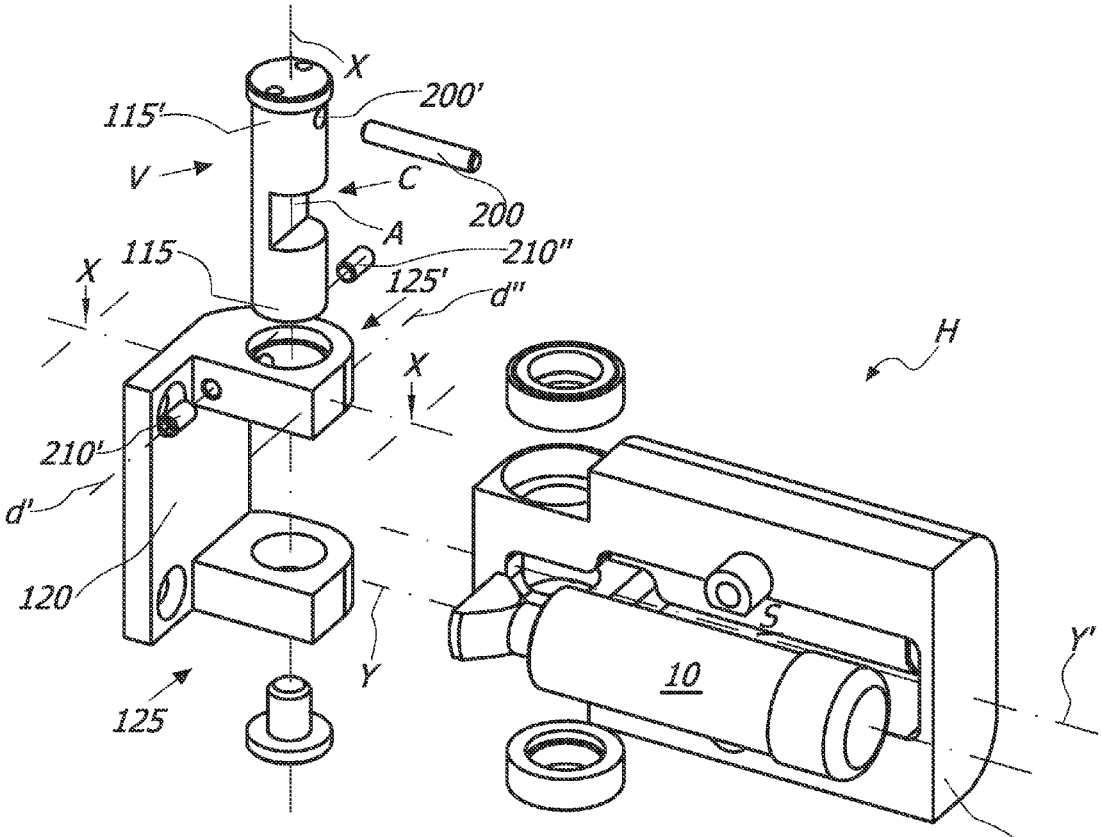
FIGS. 10*a*, 10*b* and 10*c* are respectively sectioned, top and partially sectioned along a plane X-X views of a third embodiment of the hinge device H in which the angular position of the substantially flat operative surface A of the cam element C is adjustable.
Figure 10B:
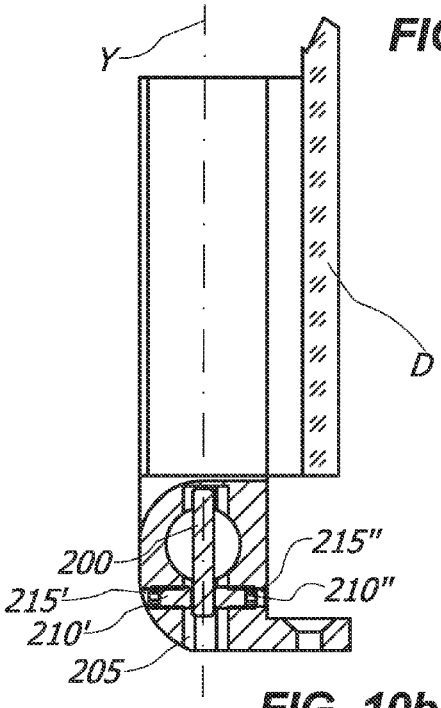
Figure 10C:
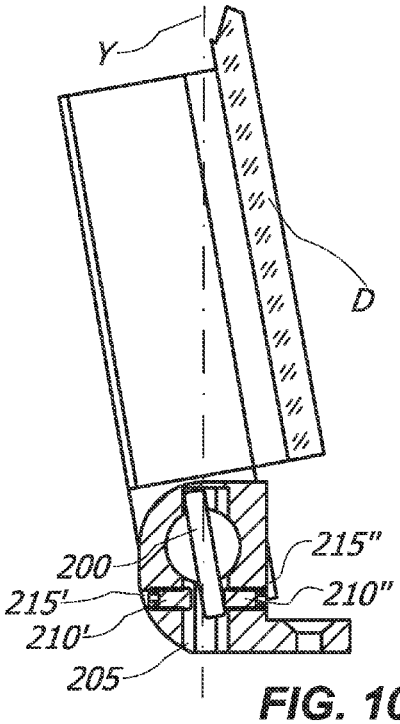

Further, the latter embodiments may have edges E both rounded, as shown in FIGS. 7*c* and 7*d*, so that the closure element always closes automatically also from the completely open position, and tapered, as shown in FIGS. 7*e* and 7*f*, so that the closure element has a stop position in the open position.

Advantageously, the cam element C may be made according to the teachings of the international application WO2007/125524 and WO2011/016000, which is referred to for proper consultation.

The piston device 1 may include a tubular body 10, preferably of cylindrical or parallelepiped-like shape, having a front portion 12 susceptible to be faced towards the substantially flat operative surface A of the hinge device H and a rear portion 13 which includes a bottom wall 14.

The annexed figures show two embodiments of the piston device 1.

In a first embodiment, shown by way of example in FIGS. 2*a* to 2*d*, the tubular body 10 may include a single closing cap 14', located in correspondence of the rear portion 13 and which may at least partially define the bottom wall 14.

On the other the in a second embodiment, shown by way of example in FIGS. 1*a* to 1*d*, the tubular body 10 may include both the closing cap 14' in correspondence with the rear portion 13 and a further closing cap 14" located in correspondence of the front portion 12.

The first embodiment with the single closing cap 14' has the advantage of having smaller dimensions than the second embodiment.

The tubular body 10, which may be removably insertable into the seat S of the hinge body B, may suitably include an operating chamber 15 defining a longitudinal axis Y.

Conveniently, as particularly shown in FIG. 3*a*, the hinge body B of the hinge device H, and in particular its seat S, may be configured to allow the insertion/disinsertion of the piston device into/from the seat S by sliding along a plane $\pi$ substantially perpendicular to the axis X and substantially parallel to the axis Y'.

In some alternative embodiments, as shown in FIGS. 22 to 25*b*, the seat S of the hinge body B may include a pass-through or blind bore 400 extending along the longitudinal axis Y' for providing access into the hinge body B in a direction substantially parallel to or coinciding with the axis Y'.

The hinge device H may further comprise an abutment member 410 within the bore 400 adapted to abut against the tubular body 10 of the piston device 1 during insertion thereof in the seat S. Advantageously, the abutment member 410 may be adapted to abut against the bottom wall 14 of the tubular body 10 of the piston device 1.

Figures 22, 23A, 23B:
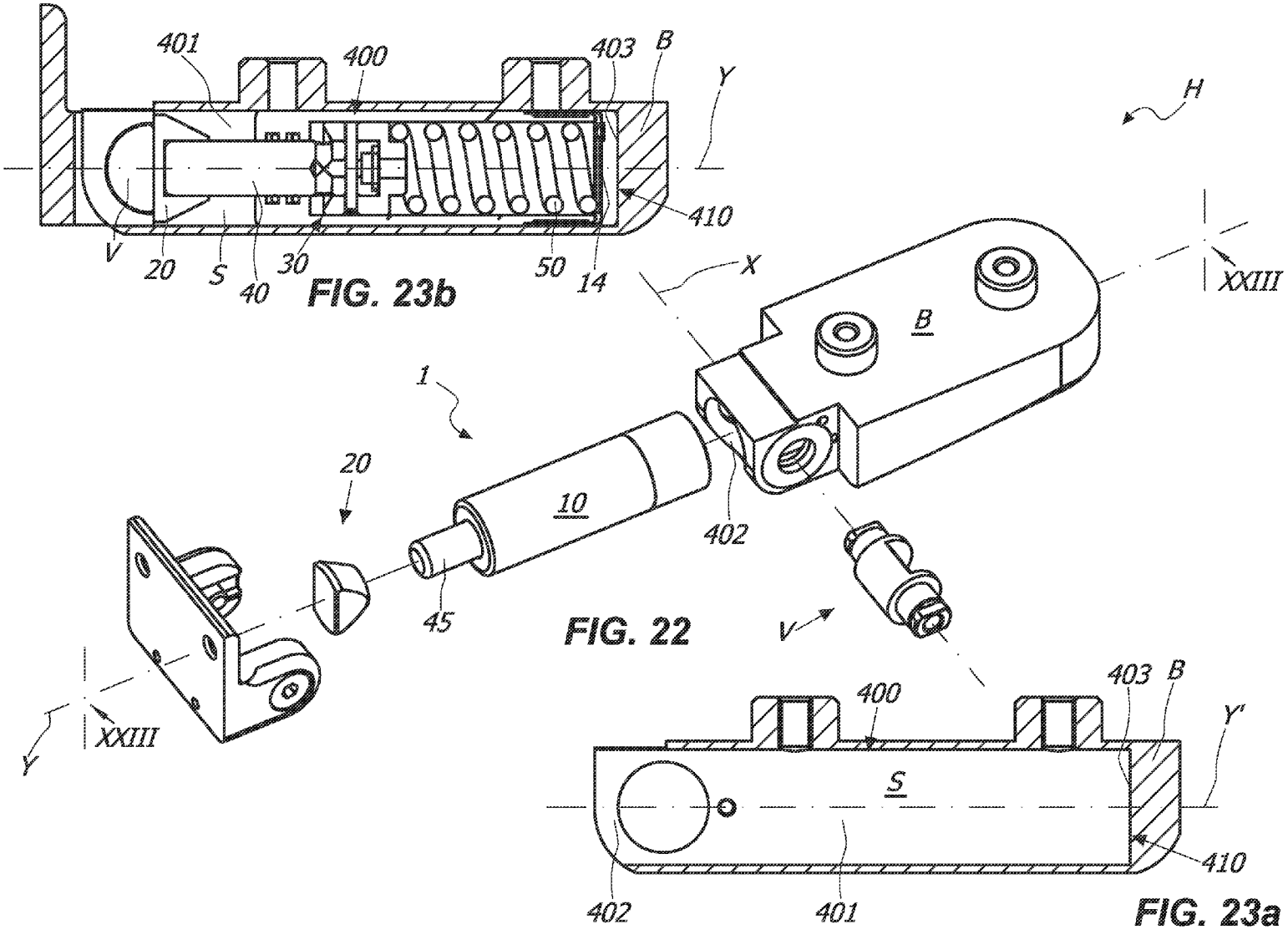
FIG. 22 is an exploded axonometric view of a further embodiment of the system including the hinge device H and the piston device 1.
FIGS. 23*a* and 23*b* are respective sectioned view taken along a plane XXIII-XXIII of the hinge device H and the system of the latter and the piston device 1 of FIG. 22.

In a first embodiment, as shown in FIGS. 22 to 23*b*, the bore 400 may be a blind bore 401 which includes an opening 402 facing the pivot member V and an end wall 403 opposite thereto. In this embodiment, the abutment member 410 may include or may consist of the end wall 403. Advantageously, in this embodiment the bottom wall 14 of the tubular body 10 of the piston device 1 abuts against the end wall 403 of the blind bore 401.

Figure 24:
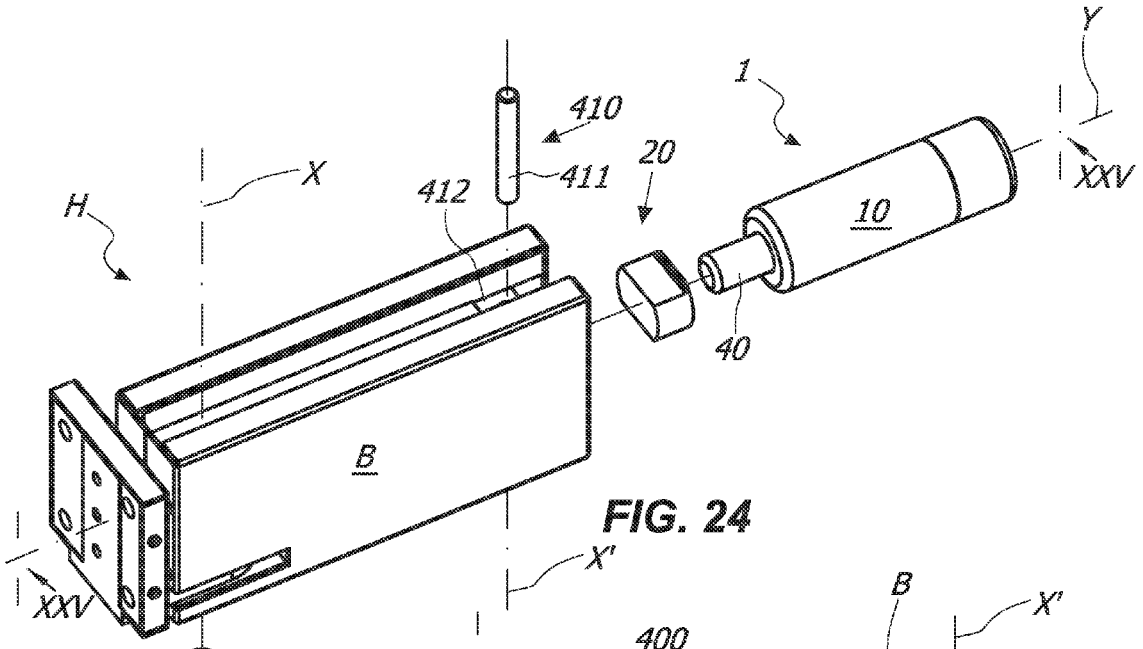
FIG. 24 is an exploded axonometric view of a further embodiment of the system including the hinge device H and the piston device 1.
Figure 25A:
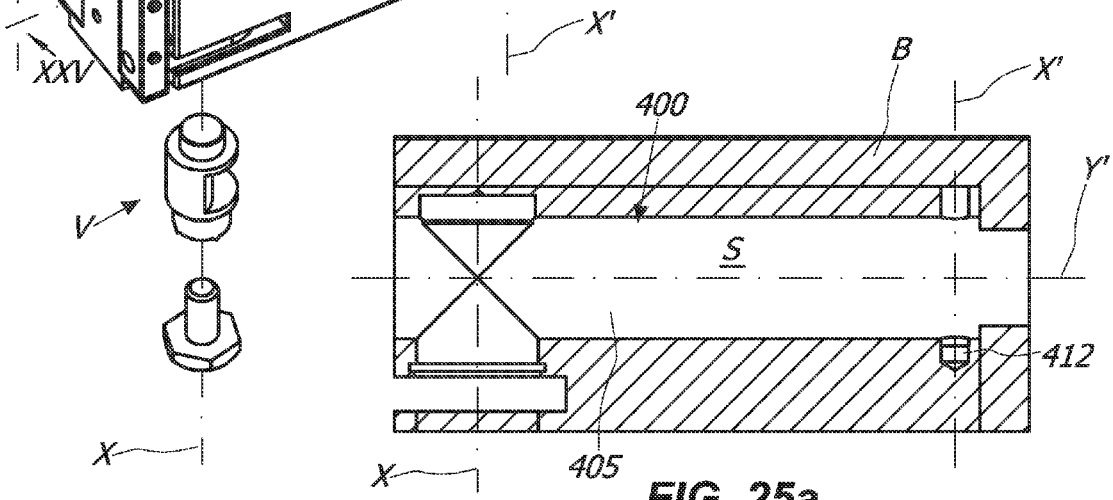
FIGS. 25*a* and 25*b* are respective sectioned view taken along a plane XXV-XXV of the hinge device H and the system of the latter and the piston device 1 of FIG. 24.
Figure 25B:
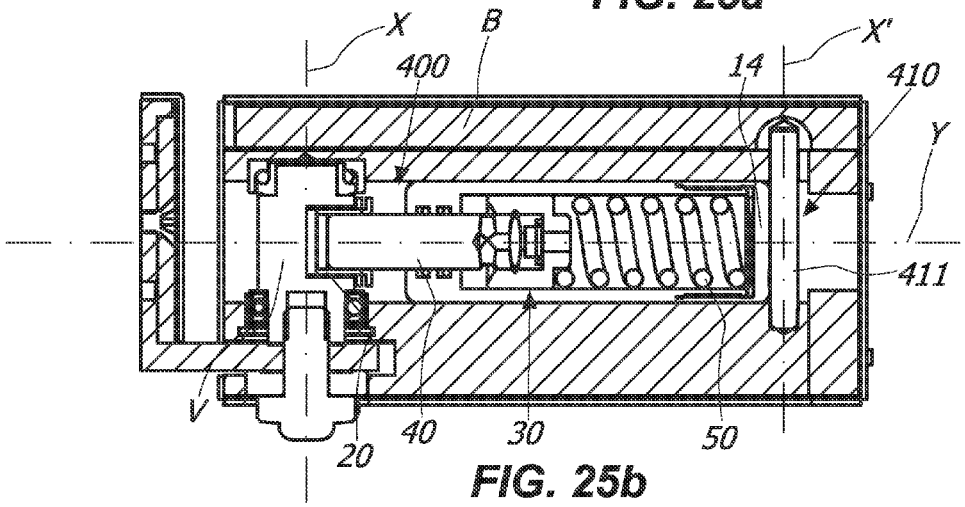

In a further embodiment, as shown in FIGS. 24 to 25*b*, the bore 400 may be a pass-through bore 405. In this embodiment, the abutment member 410 may be a pin 411 substantially transversely inserted within the pass-through bore 405 in a suitable seat 412. Advantageously, in this embodiment the bottom wall 14 of the tubular body 10 of the piston device 1 abuts against the pin 411.

Advantageously, the pin 411 may extend along an axis X' substantially parallel to the axis X of the pivot member V.

Once the piston device 1 is inserted into the seat S the axis Y of the former may coincide with the axis Y' of the latter.

The piston device 1 may further include an actuating head 20, external to the tubular body 10, which may remain facing the cam element C of the hinge device H to interact therewith.

To do this, the actuating head 20 may include a biasing element 21 with a substantially flat pushing face 22 adapted to interact with the substantially flat operative surface A of the pivot member V. The biasing element 21 may be configured so as to complementarily fit in the compartment V" of the pivot member V that includes the substantially flat operative surface A.

Figure 20A:
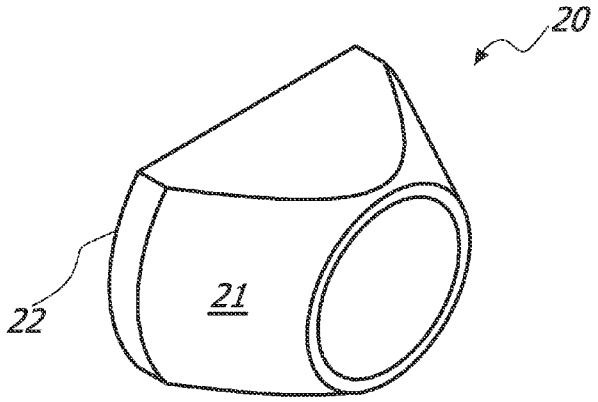
FIGS. 20*a*, 20*b* and 20*c* are axonometric views of some embodiments of the actuating head 20.
Figure 20B:
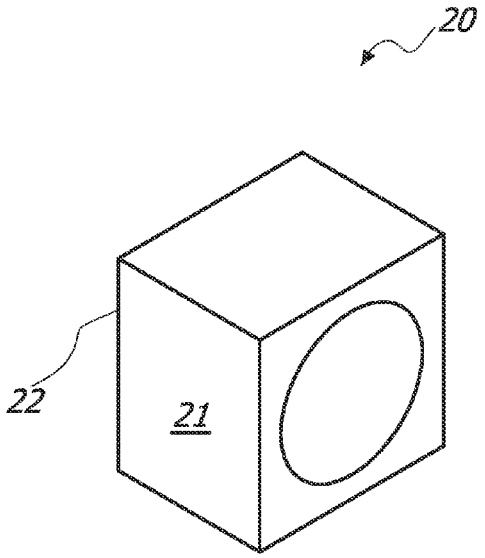
Figure 20C:
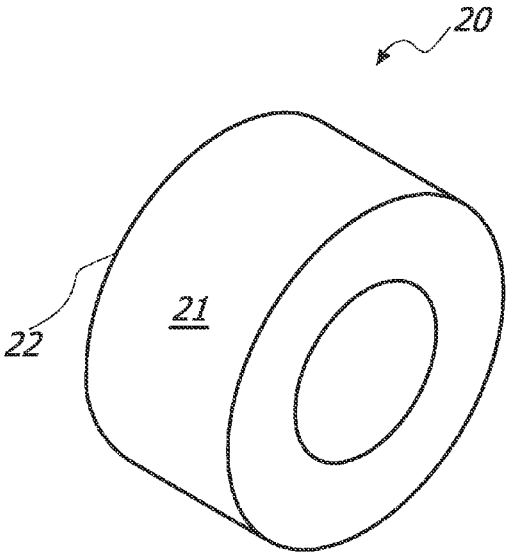

As particularly shown in FIGS. 20*a*, 20*b* and 20*c*, the biasing element 21 may have any shape, for example trapezoid-like, parallelepiped-like, cylindrical or disk-shaped.

However, the biasing element 21 may advantageously have a generally plate-like shape, in accordance with the teachings of the international application WO2011016000, which is referred to for proper consultation.

Figure 4A:
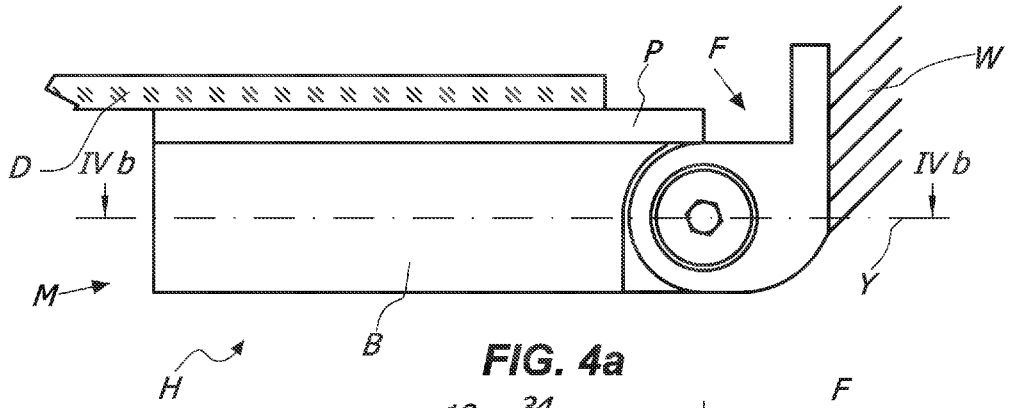
FIGS. 4*a*, 4*b* and 4*c* are respectively top and sectioned along respective planes indicated IV b-IV b and IV c-IV c views of the hinge device H with the moving element M in the closed position.
Figure 4B:
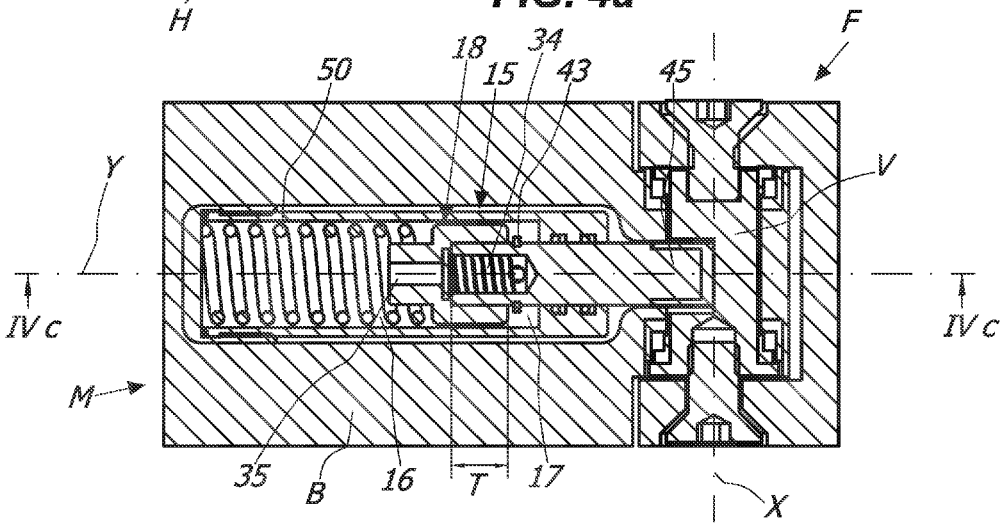
Figure 4C:
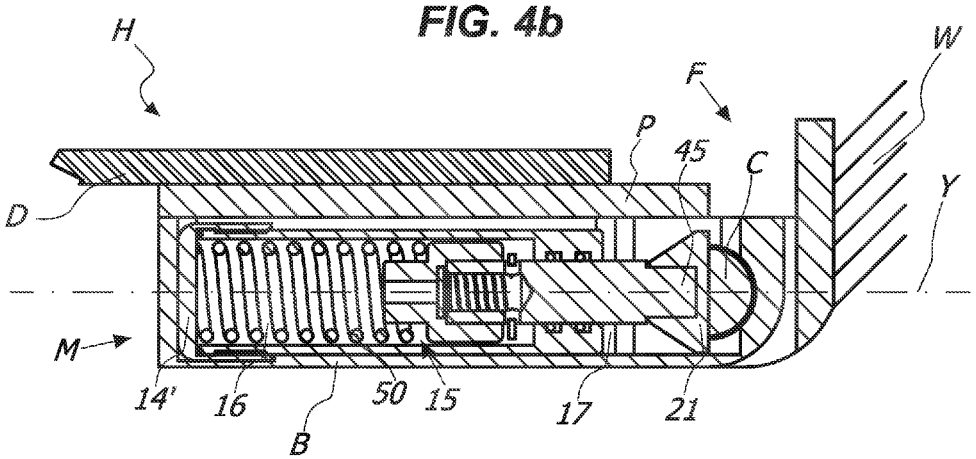
Figures 5A, 5B, 5C:
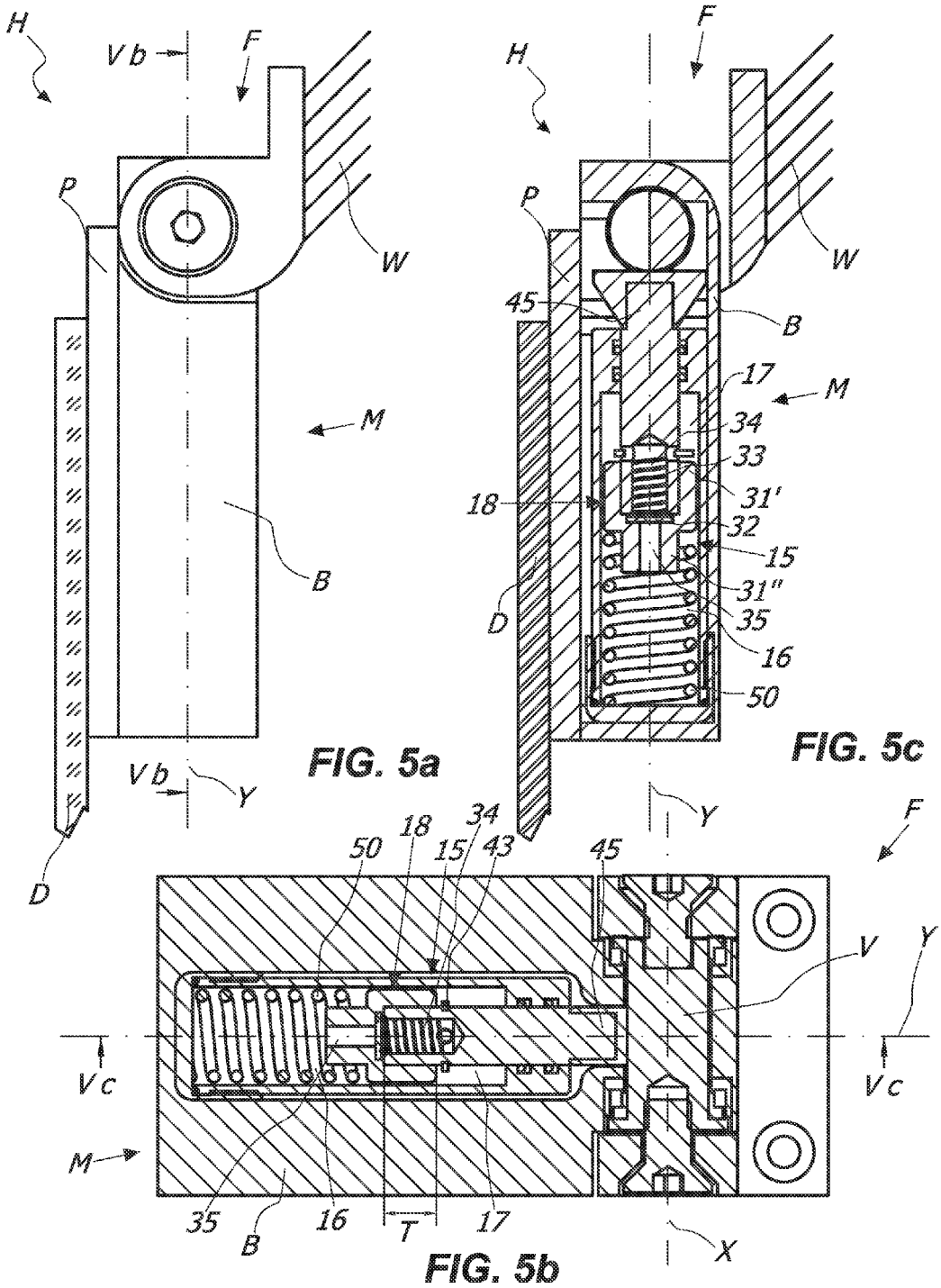
FIGS. 5*a*, 5*b* and 5*c* are respectively top and sectioned along respective planes indicated V b-V b and V c-V c views of the hinge device H with the moving element M in the open position.
Figure 6A:
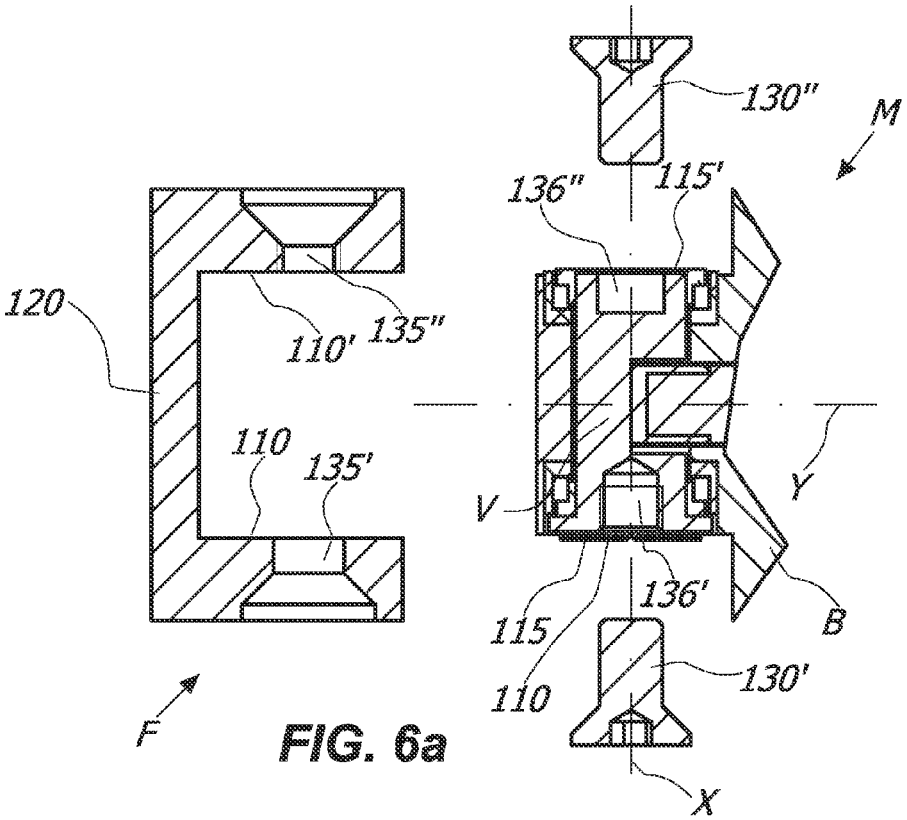
FIGS. 6*a* and 6*b* are sectional views respectively totally and partially exploded of a first embodiment of the hinge device H in which the angular position of the substantially flat operative surface A of the cam element C is adjustable.
Figure 6B:
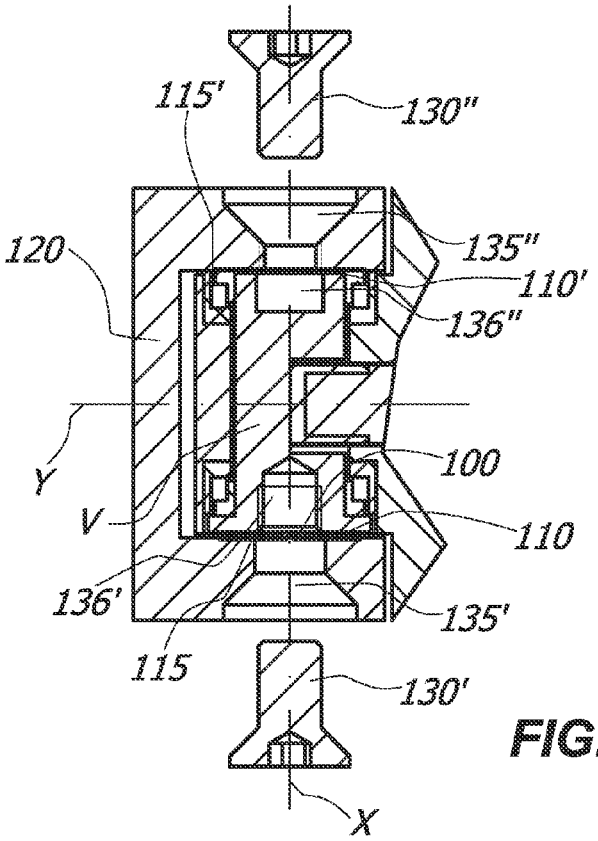

The piston device 1 may further include a plunger member 30 slidably movable in the operating chamber 15 along the axis Y between a retracted end position, shown in FIGS. 5*a* to 5*c*, and an extended end position, shown in FIGS. 4*a* to 4*c*.

Although in the particular embodiment shown in the attached figures the retracted end position of the plunger member 30 corresponds to the open position of the movable element M and the extended end position corresponds to the closed position thereof, it is understood that it may be possible also the opposite, i.e. that the extended end position of the plunger member 30 corresponds to the open position of the movable element M and the retracted end position corresponds to the closed position thereof, without departing from the scope of protection expressed by the appended claims.

Conveniently, the actuating head 20 and the plunger member 30 may be mutually connected to unitary move along the axis Y.

In particular, the actuating head 20 may move unitary with the plunger member 30 between a position which is proximal to the front portion 12 of the tubular body 10, corresponding to the retracted end position of the plunger member 30, and a position distal therefrom, corresponding to the extended end position of the plunger member 30.

To this end, a rod 40 may be provided passing through the front portion 12 of the tubular body 10 so as to be telescopically coupled therewith. The rod 40 may include a first end 41 within the operating chamber 15 coupled with the plunger member 30 and a second end 42 external to the operating chamber 15 coupled with the actuating head 20.

Conveniently, the operating chamber 15 may include elastic contrast means, for example a compression spring 50, acting on the plunger member 30 to return it from the retracted end position toward the extended end position. In this way, the spring 50 moves the actuating head 20 from the proximal position to the distal one.

In other words, the elastic contrast means 50 may be configured to move between a position of maximum and minimum elongation, the positions of maximum and minimum elongation thereof respectively coinciding with the distal and proximal positions of the actuating head 20.

Moreover, since the substantially flat operative surface A of the pivot member V and the front pushing face 22 of the actuating head 20 may be mechanically disconnected to each other, it is apparent that the elastic contrast means 50 cannot act on the contrary.

In other words, the elastic contrast means 50 cannot act on the plunger member 30 to return the actuating head 20 from the distal to proximal position, such as e.g. in the door closer according to the teachings of the documents U.S. Pat. No. 2,588,010 and US2010/024159.

It is understood that any other elastic means may be employed in place of the spring 50, for example a fluid cushion, without departing from the scope of protection expressed by the appended claims.

Conveniently, the operating chamber 15 may further include a working fluid, e.g. oil, acting on the plunger member 30 to hydraulically counteract the action of spring 50.

This way, the hinge device H control the rotation of the movable element M, both during opening and closing thereof.

More generally, the hinge device H ensures a controlled movement of the closure element D, both during opening and closing thereof.

This allows e.g. to prevent the closure element D during closing strongly impacts against the frame. Further, during opening the controlled movement prevents the closure element D to abruptly open, so as to protect both the door per se and any user who is in its action range.

The fact that the substantially flat operative surface A of the pivot member V and the front pushing face 22 of the actuating head 20 are mechanically disconnected to each other makes the piston device 1 and/or the hinge device H particularly useful for rotatably moving closure elements D made of a fragile material, such as glass doors.

In case of violent opening or closing of the door, for example caused by a child or by a blow wind, the movable element is always free to rotate independently from the bias of the resistance of the plunger member 30, thereby avoiding an abrupt blocking of the closing element D.

Depending on the configuration of the elastic contrast means 50 of the piston device 1, the hinge device H may act as a closing hinge or as a damping hinge for the control of the closure element D during opening and/or during closing thereof.

In the first case, the elastic contrast means 50 may be susceptible to act on the plunger member 30 to automatically return the movable element M from the open position toward the closed one.

In this case, the elastic contrast means 50 shall be dimensioned for this purpose. Therefore, a person skilled in the art must select them to ensure the automatic closing of the closing element D from the open position.

Advantageously, the elastic contrast means 50 may include a bias spring.

It is understood that the closing hinge may also have the damping function, during opening and/or during closing.

In the second case, the elastic contrast means 50 may have the only function of returning the plunger member 30 from the retracted position to the extended one, and not also the function of closing the closure element D. As a consequence, they may have a lower power with respect to the first case.

Therefore, the person skilled in the art has to choose them to ensure such a function.

Suitably, the substantially flat operative surface A of the pivot member V and the front pushing face 22 of the actuating head 20 may be substantially parallel when the actuating head 20 is in the distal position and substantially perpendicular when the same actuating head 20 is in the proximal one.

The shape of the cam element C determines the position of the actuating head 20 upon the closing or the opening of the closure element D.

For example, in the embodiments shown in FIGS. 4*a* to 5*b* the distal position of the actuating head 20 may correspond to the closed position of the movable element M of the hinge device H, while the proximal position of the same actuating head 20 may correspond to the open position of the movable element M of the hinge device H.

In this case, the pivot member V may include a single substantially flat operative surface A, which may be substantially parallel to the front pushing face 22 when the closure element D is in the closed position, while it may be substantially perpendicular to the front face 22 when the closure element D is in the open position.

Figure 21A:
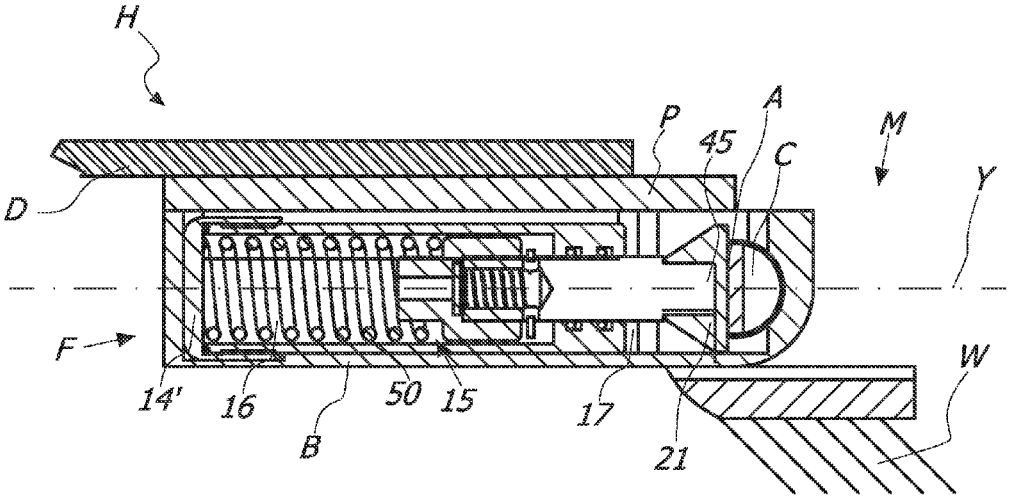
FIGS. 21*a* and 21*b* are axially sectioned views of a further embodiment of the hinge device H.
Figure 21B:
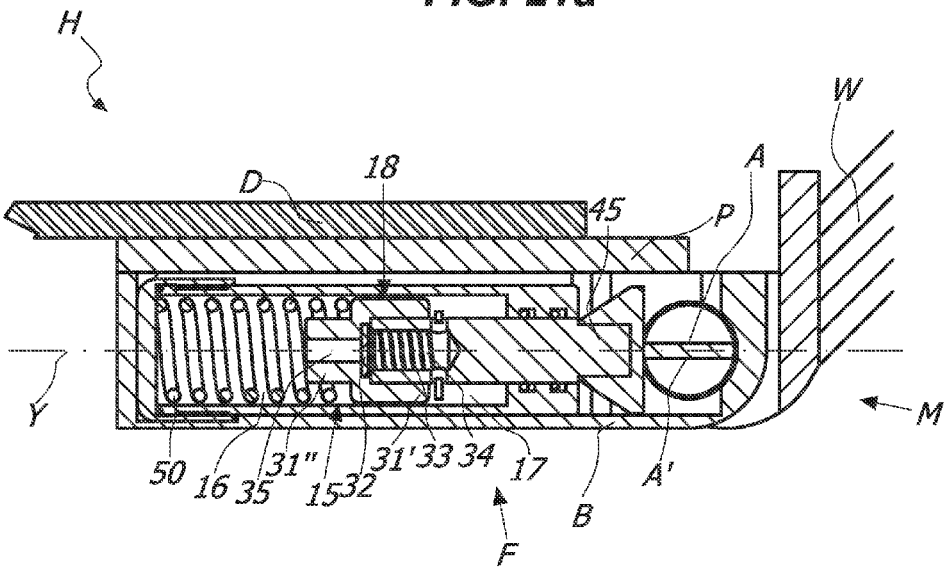

In a further embodiment, as shown in FIGS. 21*a* and 21*b*, the distal position of the actuating head 20 may correspond to the open position of the movable element M of the hinge device H, while the proximal position of the same actuating head 20 may correspond to the closed position of the movable element M of the hinge device H.

In this case, the pivot member V may include a pair of substantially flat operative surfaces A, A', which may be susceptible to selectively interact with the front pushing face 22 according to the opening direction of the closure element.

This operative surface A may be substantially parallel to the front pushing face 22 when the closure element D is in the open position, while it may be substantially perpendicular to the front face 22 when the closure element D is in the closed position.

Conveniently, the plunger member 30, which may include a tubular body with a front portion 31' and a rear portion 31" coupled with the spring 50, may be able to separate the operating chamber 15 in a first and a second variable volume compartments 16, 17, fluidly communicating with each other, and preferably reciprocally adjacent.

Advantageously, the spring 50 may be placed in the first compartment 16, so that the first and the second compartments 16, 17 may have respectively the maximum and minimum volume at the distal position of the actuating head 20, and the minimum and maximum volume at the proximal position thereof.

Advantageously, the plunger member 30 may be inserted in the operating chamber 15 so as to define therewith an interspace 18 for the passage of the working fluid between the first and the second compartments 16, 17.

In other words, the interspace 18 may at least partially define a circuit for the passage of the working fluid between the first and the second compartments 16, 17.

Conveniently, the plunger member 30 may be inserted in the operating chamber 15 with a predetermined clearance, which may be of a few tenths of a millimeter, so that the interspace 18 may have a tubular shape.

On the other hand, the plunger member 30 may be inserted in the operating chamber 15 substantially without clearance, so that the interspace 18 may be defined by one or more tapered portion made on the plunger member 30.

In a preferred but not exclusive embodiment, shown in FIGS. from the 15*th* to 15*c*, the working fluid may pass between the first and the second compartments 16, 17 exclusively through the interspace 18, both upon opening of the closure element D and upon the closing thereof.

Conveniently, the plunger member 30 may include valve means for controlling the passage of the working fluid between the first and the second compartments 16, 17 upon rotation of the movable element M in the opening or closing direction.

In a preferred but not exclusive embodiment, the valve means, which may be of the one-way type, may include a disk 32 and, possibly, a correspondent contrast spring 33.

The absence or presence of the contrast spring 33 may determine the greater or lesser progressivity of the damping effect of the piston device 1.

Figure 16C:
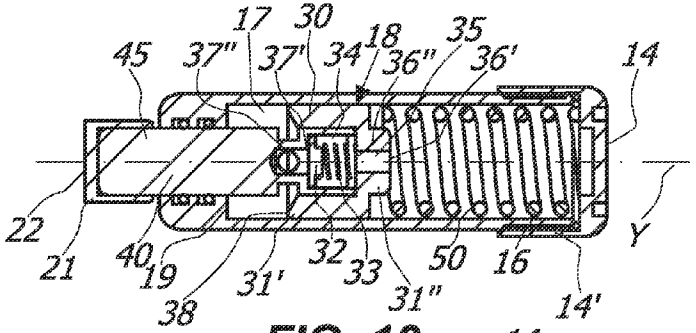
FIGS. 16*a*, 16*b* and 16*c* are respectively exploded axonometric and axially sectioned views with the actuating head 20 respectively in the distal and proximal position of a further embodiment of the piston device 1.
Figure 16B:
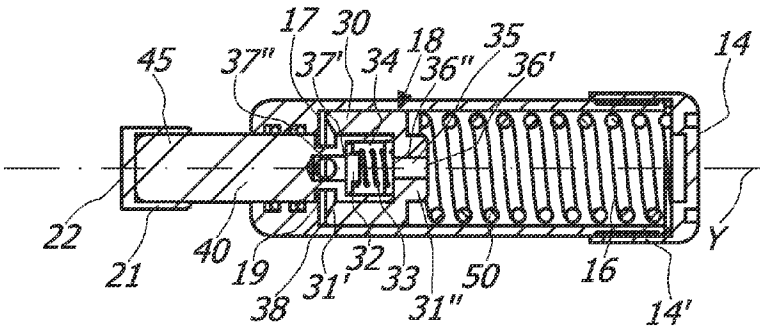
Figure 16A:
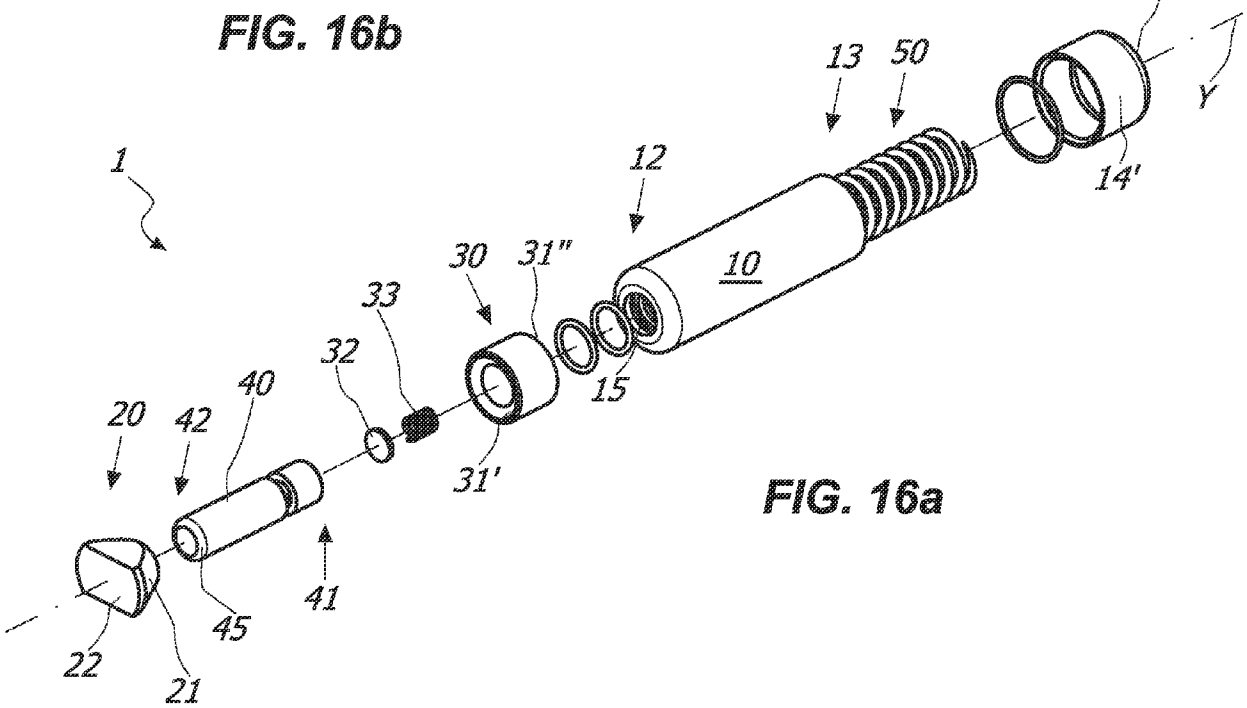
Figure 17C:
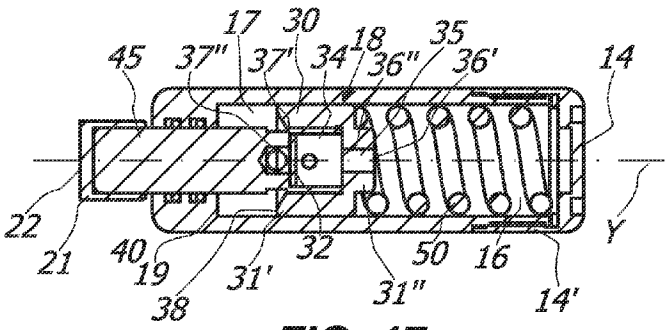
FIGS. 17*a*, 17*b* and 17*c* are respectively exploded axonometric and axially sectioned views with the actuating head 20 respectively in the distal and proximal position of a further embodiment of the piston device 1.
Figure 17B:
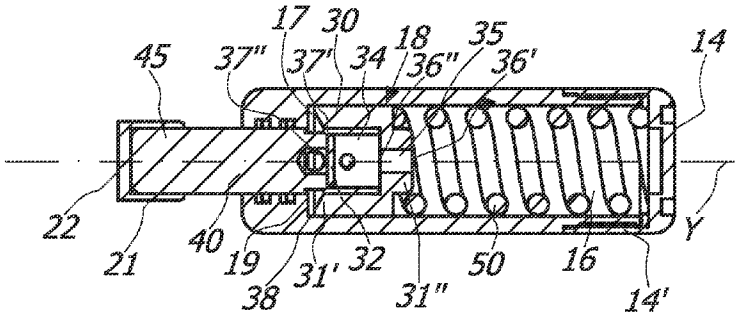
Figure 17A:
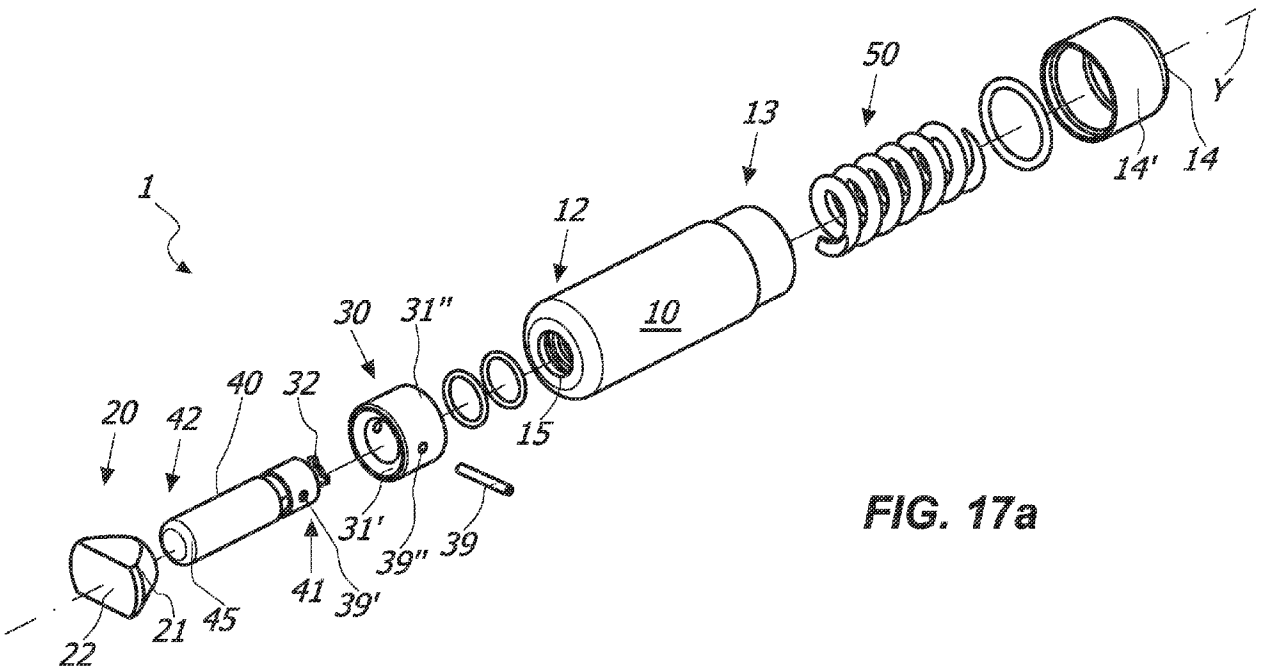
Figure 18C:
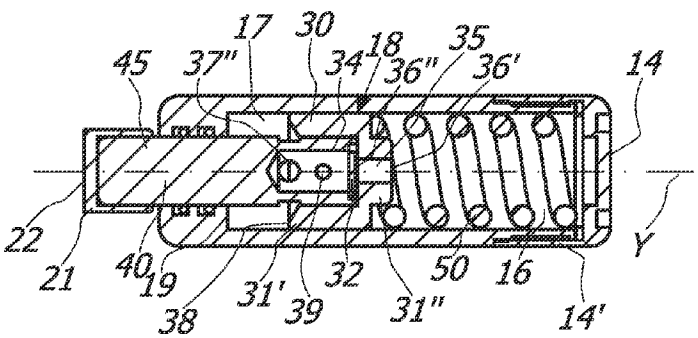
FIGS. 18*a*, 18*b* and 18*c* are respectively exploded axonometric and axially sectioned views with the actuating head 20 respectively in the distal and proximal position of a further embodiment of the piston device 1.
Figure 18B:
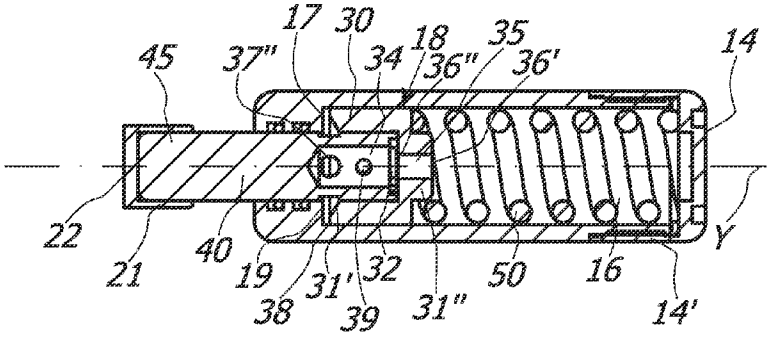
Figure 18A:
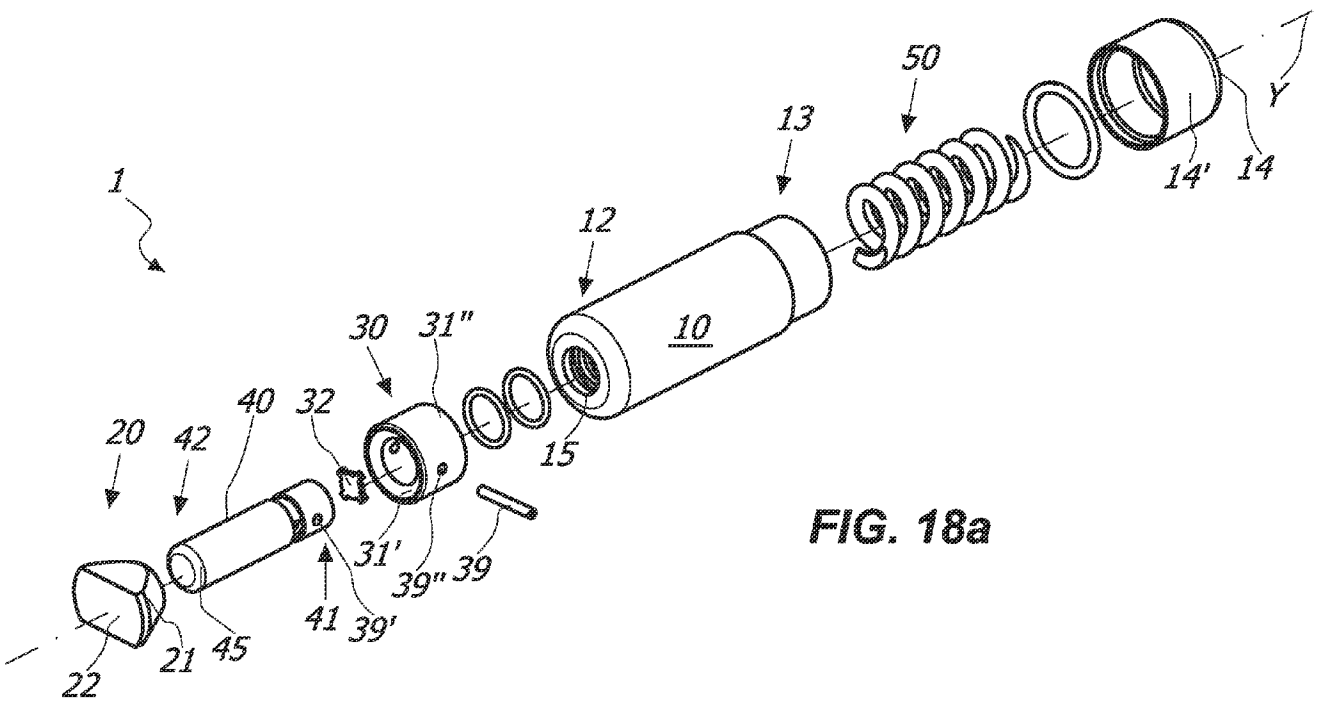

For example, in the embodiment shown in FIGS. 16*a* to 16*c* the valve means include the contrast spring 33, while in the embodiment shown in FIGS. from 17*a* to 17*c* they are free of the latter.

Advantageously, the disc 32 and, if present, the relative spring 33 may be inserted in a suitable seat 34, defined by the blind hole in the rear portion 41 of the stem 40. The latter, in turn, is susceptible to engage the front portion 31 of the plunger member 30 for a portion T thereof.

The valve means may be inserted into the seat 34 so that the disc 32, possibly pushed by the spring 33, selectively blocks the passage of the working fluid between the first and second compartment 16, 17, forcing the fluid to pass through the interspace 18.

The pass-through hole 35 and the blind one 34 may be susceptible to put in mutual fluid communication the first and the second compartments 16, 17 passing through the disc 32, which controls the flow passage of working fluid.

Advantageously, the pass-through hole 35 may have a first opening 36' for the working fluid which is in the first compartment 16 and a second opening 36" to allow the passage of the working fluid.

The blind hole 34 may further have a first opening 3T which faces the second opening 36" of the pass-through hole 35 and a second opening 37" to allow the passage of the working fluid from/towards the second compartment 17.

The disc 32, possibly pushed by the spring 33, may be susceptible to selectively obstruct the opening 36" or 37'.

This configuration may allow determining the passage of working fluid through the valve means 32, 33 and the interspace 18, thus controlling the damping effect of the piston device 1.

In fact, the valve means 32, 33 may be configured to control the passage of the working fluid between the first and the second compartments 16, 17 upon the passage of the actuating head 20 from one between the proximal and distal positions towards the other between the proximal and distal positions, while the interspace 18 may allow the passage of the working fluid between the first and second compartments 16, 17 upon the moving back of the actuating head 20 from the other between the proximal and distal positions towards the starting one.

In a preferred but not exclusive embodiment, shown for example in FIGS. 1*a* to 2*d*, the disc 32 and the relative spring 33 may be configured to open upon the passage of the actuating head 20 from the distal position to proximal one, so as to allow the passage of the working fluid from the first compartment 16 to the second compartment 17, and to close upon the passage of the same actuating head 20 from the proximal position to the distal one, so as to force the passage of the working fluid from the second compartment 17 to the first compartment 16 through the interspace 18.

In this embodiment, the opening of the valve means may correspond to the opening of the movable element M, while the closing of the same valve means may correspond to the closing thereof.

On the other hand, in an alternative embodiment, shown for example in FIGS. 16*a* to 16*c*, the valve means may be configured to work on the contrary.

In fact, the valve means may open upon the passage of the actuating head 20 from the proximal position to the distal one, so as to allow the passage of the working fluid from the second compartment 17 to the first compartment 16, and may close upon the passage of the actuating head 20 from the distal position to the proximal one, so as to force the passage of the working fluid from the first compartment 16 to the second compartment 17 through the interspace 18.

Preferably, the biasing element 21 may be removably connected to the second portion 42 of the stem 40. To this end, the second portion 42 may have an elongated appendix 45 adapted to complementarily engage in a suitable seat of the biasing element 21.

This embodiment allows minimizing the manufacturing costs of the piston device 1. In fact, it is possible to manufacture the biasing element 21 in a first metal material having high mechanical properties, such as stainless steel, while the rod 40 may be made of a second metal material having relatively less mechanical properties, for example brass or aluminum.

In fact, the biasing element 21 may have to bear all the mechanical stress caused by the interaction with the cam element C. Further, the biasing element 21 may work substantially dry or anyway not in an oil bath, so that it wears more of the components that are in an oil bath.

Advantageously, the stem 40, the valve means 32 and 33, the plunger member 30 and the elastic contrast means 50 may be inserted sequentially "packed" into the tubular body 10, so as to be mutually coupled in the operating chamber 15 without screws or similar connecting means. This allows to minimize the overall dimensions and to maximize the duration of the piston device 1.

In order to prevent the decoupling of the stem 40 from the front part 12 of the tubular body 10, suitable decoupling-preventing means may be provided.

Conveniently, the decoupling-preventing means may include a stop element fixed to the rod 40 and/or to the plunger member 30 susceptible to impact against the inner wall 19 of the tubular body 10 facing the bottom wall 14.

For example, as shown in FIGS. 1*a* to 2*d*, a blocking ring 43 preferably of the Seeger type may be provided.

The blocking ring 43 may be fitted on the rod 40 by insertion in a suitable annular seat 44. Advantageously, the position of the seat 44 on the rod 40 may be in a spatial relationship with the inserting portion T of the same rod 40 into the portion 31' of the plunger member 30 such that when the actuating head 20 is in the extended position, as shown in FIGS. 2*c* and 2*d*, the blocking ring 43 impacts against the wall 19 preventing the decoupling of the rod 40 from the plunger member 30.

On the other hand, as shown for example in FIGS. 15*a* to 18*c*, the stop element may include an abutment surface 38 of the plunger member 30 susceptible to impact with the inner wall 19.

In this case, the plunger member 30 and the rod 40 may be unitary connected to each other.

To this end, as shown for example in FIGS. 16*a* to 16*c*, the plunger member 30 and the rod 40 may be unitary coupled to each other by interference.

On the other hand, as shown for example in FIGS. 17*a* to 18*c*, a pass-through pin 39 insertable in corresponding seats 39', 39" of the rod 40 and of the plunger member 30 may be provided.

In a further aspect, as particularly shown in FIGS. 6*a* to 10*c*, the hinge device H may include means for adjusting the angular position of the substantially flat operative surface A of the pivot member V with respect to the axis Y.

It is understood that the adjustment means may equivalently be included in a hinge device H which includes the piston device 1 or in a hinge device in which the actuating head 20, the plunger member 30, the possible rod 40, the elastic contrast means 50 and the working fluid are inserted in a seat directly made within the hinge body, for example configured according to the teachings of the international applications WO2007/125524 and WO2011/016000.

In this case, the system of the actuating head 20, the plunger member 30, the possible rod 40, the elastic contrast means 50 and the working fluid may be irremovably anchored into the hinge body.

Advantageously, the hinge device H may include an anchoring element 120, which may have a substantially "C" shape, for anchoring thereof to the stationary support structure W or to the closure element D.

The anchoring element 120 may include an upper portion with a respective upper surface 110' and a lower portion with a respective lower surface 110 facing respective ends 115, 115' of the pivot member V.

The upper and lower portions may be planar, substantially parallel to the axis Y' and substantially perpendicular to the axis X. The upper and lower portions may be joined to each other by means of a joining portion, which may preferably be planar, substantially parallel to the axis X and substantially perpendicular to the axis Y'.

In a first embodiment, shown in FIGS. 6*a* to 8*c*, the adjustment means may include one or more protrusions 100 in correspondence of the respective end 115 of the pivot member V adapted to engage the corresponding surface 110 of the anchoring element 120 faced thereto.

To this end, a first threaded screw 130' inserted in a corresponding unthreaded hole 135' passing through the anchoring element 120 may be provided, which may be susceptible to engage the pivot member V in a corresponding counterthreaded blind hole 136' in correspondence of the end 115 that includes the protrusions 100.

At the opposite end, a second threaded screw 130" engaged with a corresponding counterthreaded hole 135" passing through the anchoring element 120 may be provided, which may be inserted into a corresponding unthreaded blind hole 136" in correspondence of the respective end 115' of the pivot member V.

Therefore, to change the angular position of the substantially flat operative surface A of the pivot member V with respect to the axis Y may be sufficient to unscrew the screw 130', to rotate the anchoring element 120 about the X axis to the desired position and to screw the screw 130', so as to promote the penetration of the projections 100 into the surface 110.

In a second embodiment, shown in FIGS. 9*a* to 10*b*, the adjustment means may include a pin 200 inserted into a radial hole 200' passing through at least one of the ends 115, 115' of the pivot member V and in a corresponding radial hole 205 passing through the respective end 125 of the anchoring element 120. To this end, the pin 200 may have a length greater than the one of the radial hole 200' of the pivot member V.

Preferably, the radial hole 200' may be substantially perpendicular to the axis X and to the substantially flat operative surface A, while the radial hole 205 may be substantially parallel to the axis Y.

The pin 200 may be susceptible to impact against one couple of abutment adjusting screws 210', 210" inserted into respective seats 215', 215" defining respective sliding directions d', d" thereof which may be substantially parallel to each other and substantially perpendicular to the axis X and to the axis Y'.

Suitably, the seats 215', 215" may be placed on only one side of the end 125 of the anchoring element 120 or on opposite sides thereof, as shown respectively in FIGS. 9*a* to 9*c* and 10*a* to 10*c*.

Figures 1A, 1B, 1C, 1D:
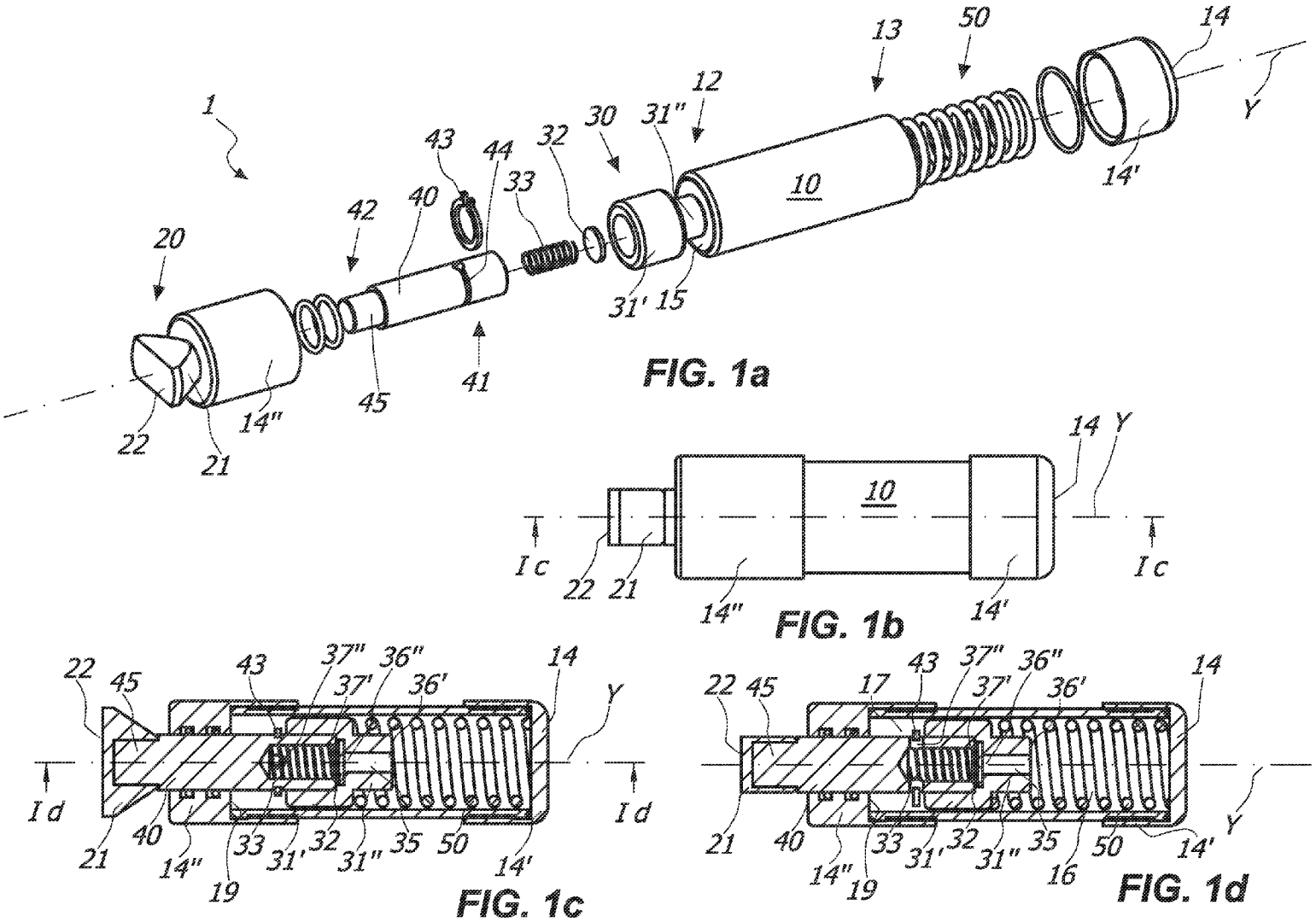
FIG. 1*a* is an exploded axonometric view of a first embodiment of the piston device 1, with in FIG. 1*b* a side view of the device of FIG. 1*a* in an assembled configuration and in FIGS. 1*c* and 1*d* some sectional views of the device of FIG. 1*b* taken along respective planes indicated I c-I c and I d-I d.
Figure 2A:
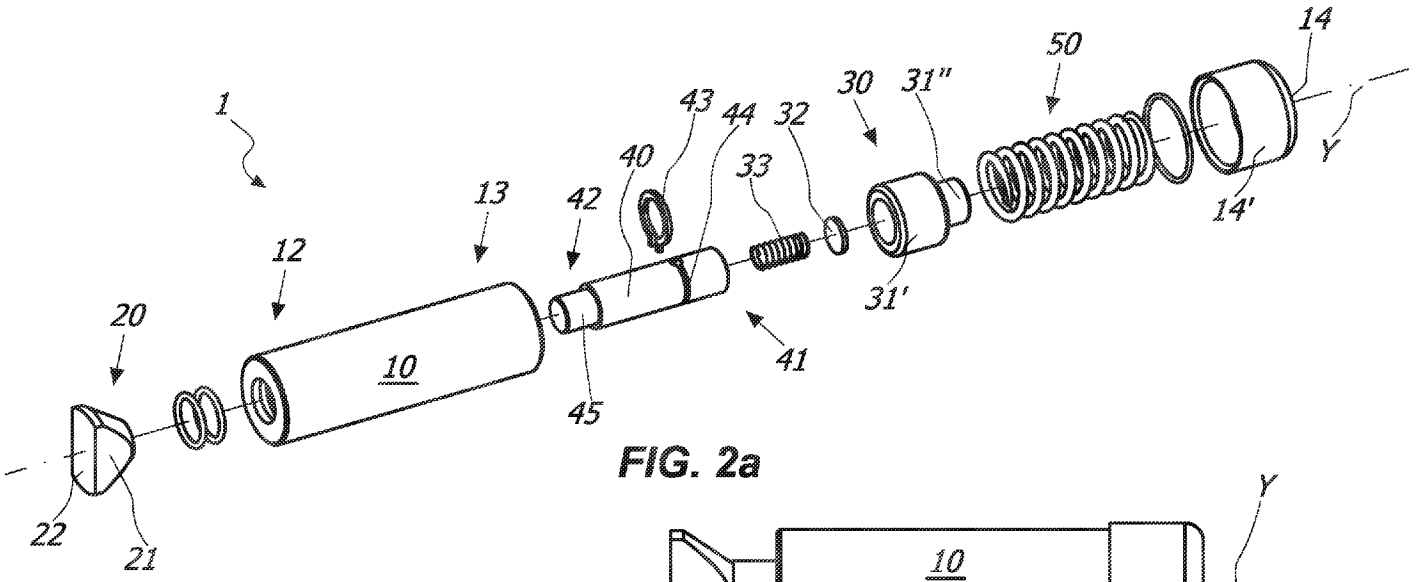
FIG. 2*a* is an exploded axonometric view of a second embodiment of the piston device 1, with in FIG. 2*b* a side view of the device of FIG. 2*a* in an assembled configuration and in FIGS. 2*c* and 2*d* some sectional views of the device of FIG. 2*b* taken along respective planes indicated II c-II c and II d-II d.
Figure 2B:
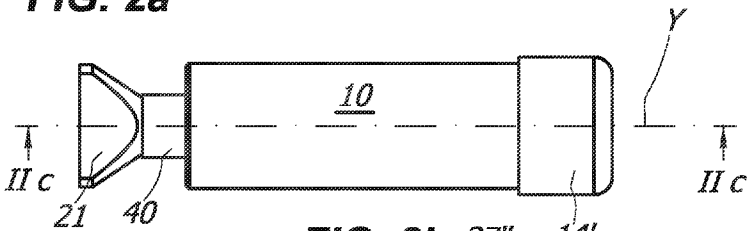
Figure 2D:
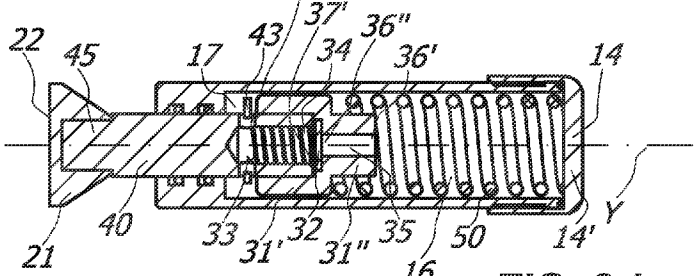
Figure 2C:
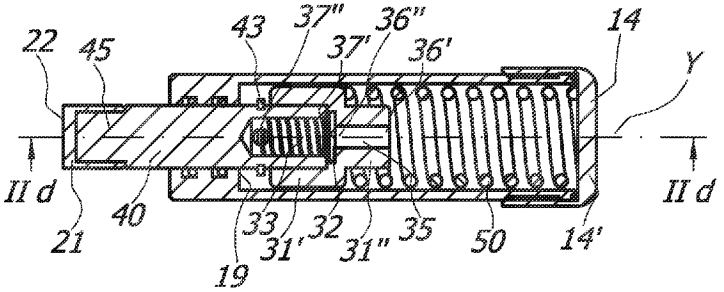
Figure 11:
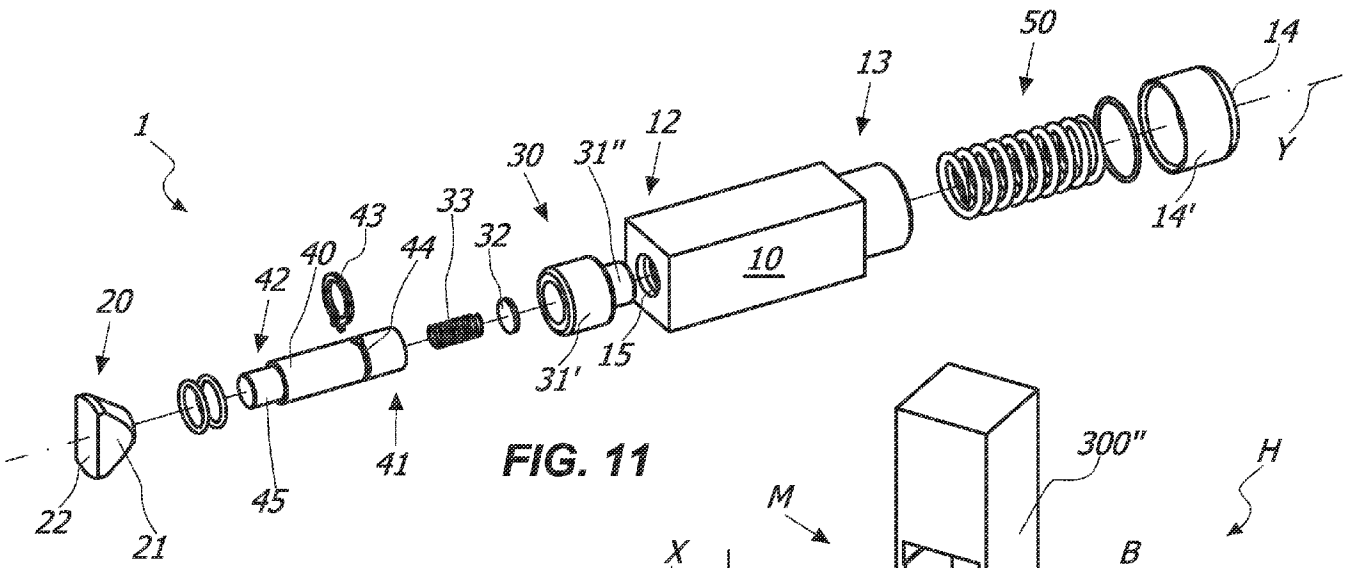
FIG. 11 is an exploded axonometric view of a further embodiment of the piston device 1.

FIG. 11 shows a further embodiment of the piston device 1, having features similar to the embodiments shown in FIGS. 1*a* and 2*a*, but having a tubular body 10 of generally parallelepiped-like shape.

Figure 12:
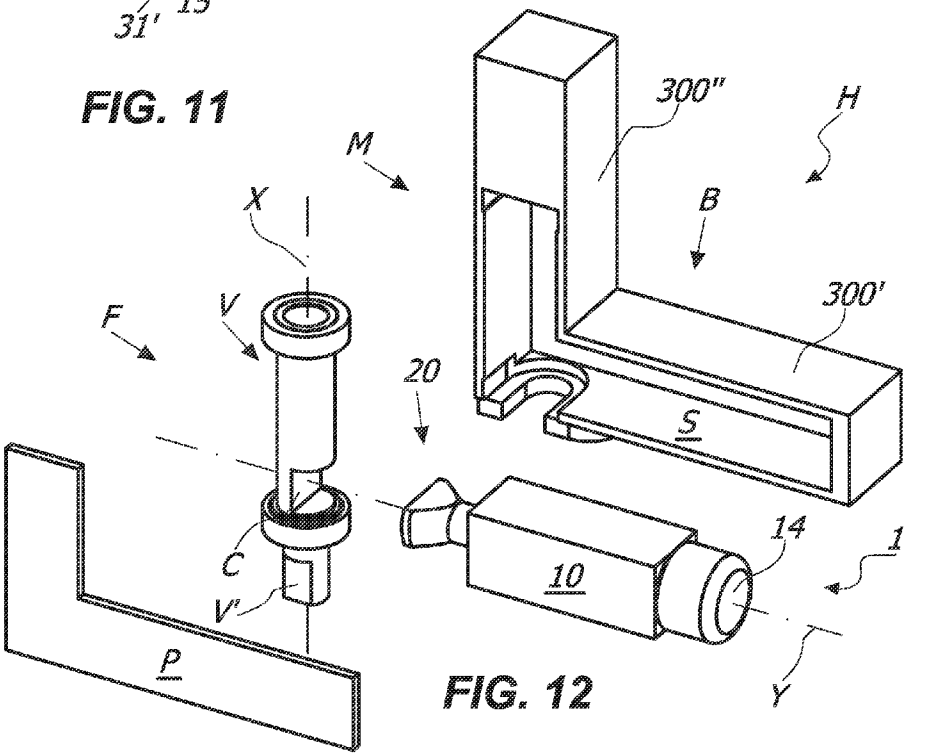
FIG. 12 is an exploded axonometric view of a further embodiment of a hinge device H susceptible to cooperate with the embodiment of the piston device 1 of FIG. 11.

This embodiment of the piston device 1 is particularly suitable to be inserted into the hinge device H shown in FIG. 12, which includes a hinge body B which defines the moving element M and a pivot member V defining the fix element F.

To this end, the pivot member V may include a shaped end portion insertable into a suitable countershaped seat made e.g. in a floor, not shown in the figures because per se known.

The hinge body B may include a first elongated portion 300' which is internally hollow to define the seat S for the removable insertion of the piston device 1. Preferably, the seat S may be countershaped with respect to the tubular body 10 of the parallelepiped-like piston device 1, so as to avoid rotation thereof about the axis Y.

The hinge body B may further include a second elongated portion 300" which is internally hollow to house the pivot member V, which may define the axis of rotation X of the hinge body B.

Figure 13:
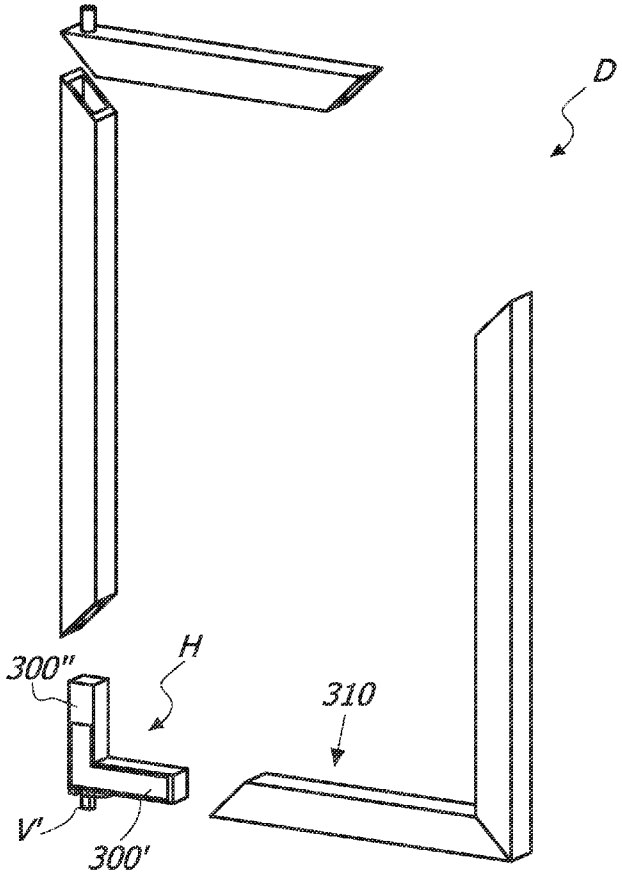
FIG. 13 is an exploded axonometric view of a closing element D, in particular a gate, in which tubular frame 310 is inserted a hinge device H in accordance with the embodiment of FIG. 12.
Figure 15C:
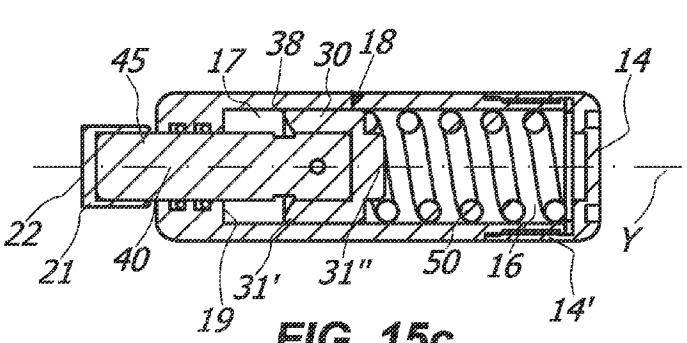
FIGS. 15*a*, 15*b* and 15*c* are respectively exploded axonometric and axially sectioned views with the actuating head 20 respectively in the distal and proximal position of a further embodiment of the piston device 1.
Figure 15B:
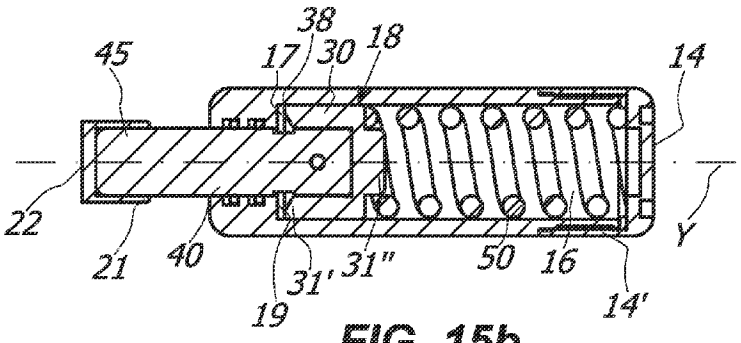
Figure 15A:
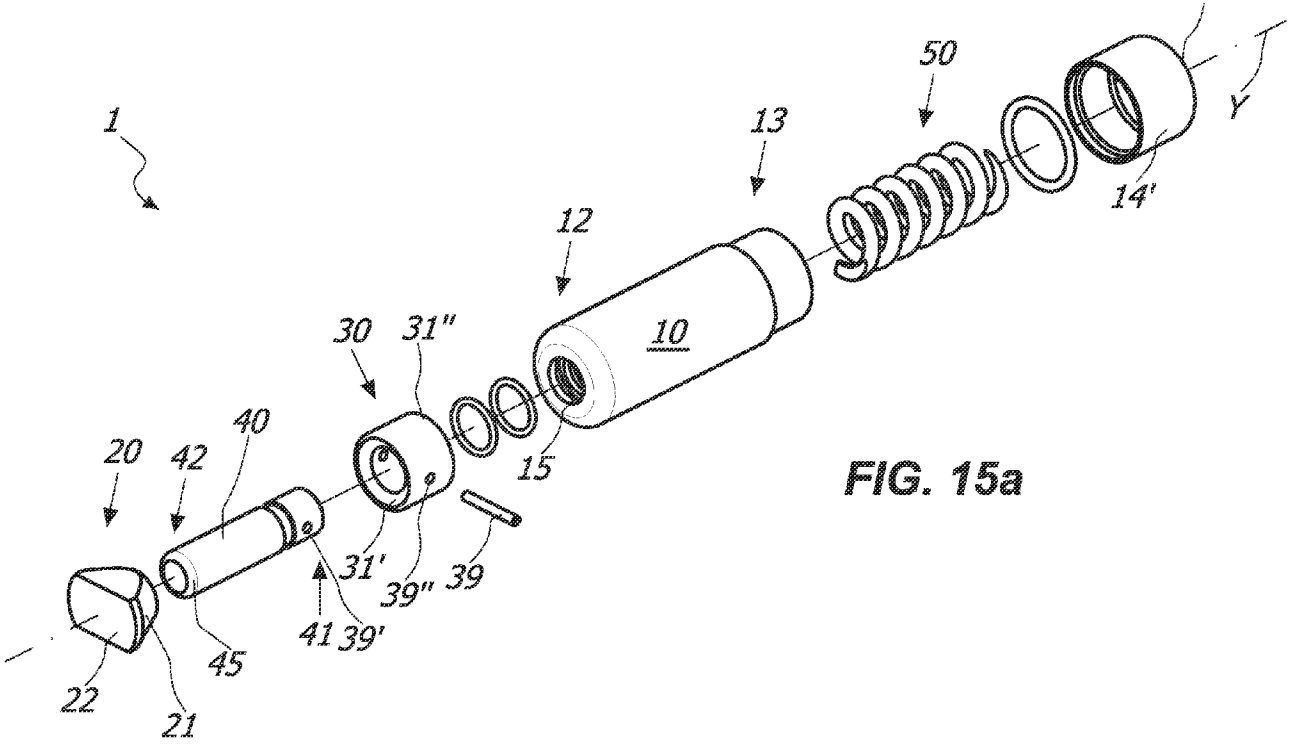

Advantageously, as particularly shown in FIG. 13, the first and/or the second elongated portions 300', 300", which may be substantially perpendicular to each other, may be slidably inserted in the tubular frame 310 of a closure element D hidden to the sight, such as a swing gate or a shutter of a cold room.

It is understood that the embodiment of the hinge device H shown in FIG. 12 can also be made in accordance with the teachings of the international applications WO2007/125524 and/or WO2011/016000. In other words, the hinge device H shown in FIG. 12 may be configured to house both the pivot member V and a piston system directly made into the seat S and non removable therefrom, according to the teachings of one of the above mentioned applications, or both.

Figure 14:
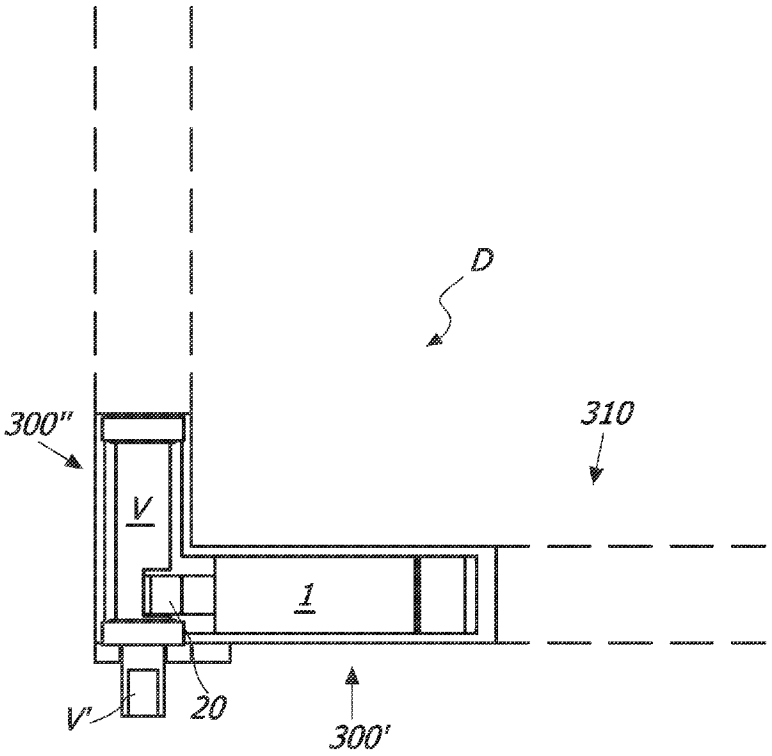
FIG. 14 is an enlarged front view of a corner area of a closing element D, such as a swing gate or the door of a cold room, in which tubular frame 310 is directly inserted a piston device 1.

In a further embodiment, shown in FIG. 14, the piston device 1 and the relative pivot member V which includes the cam element C may be directly inserted in the tubular frame 310. In other words, a closing element D may be provided, such as a swing gate or door of a cold room, which is not designed to hold the hinge device H as in FIG. 13 and that includes a tubular frame 310 suitably configured to house directly the piston device 1 and the relative pivot member V. To this end, the tubular frame 310 may provide suitable seats.

Also in this case, it is understood that the embodiment of closure element D shown in FIG. 14 can be made in accordance with the teachings of the international applications WO2007/125524 and/or WO2011/016000. In other words, the tubular frame 310 of the closure element D shown in FIG. 14 may be configured to accommodate both the pivot member V and a plunger system made directly within it and non removable therefrom, according to the teachings of one of the above mentioned applications, or both.

From the above description, it is apparent that the invention fulfils the intended objects.

In particular, the piston device 1 allows providing a hinge device H of any outer shape, since the whole hydraulic part of the hinge device is enclosed within the tubular body 10.

Apparently, the piston device 1 is extremely low cost, simple to manufacture and reliable over time due to the limited number of constituent parts.

Thanks to the particular configuration, the hinge device H and the piston device 1 may be made separately, so that the system constituted by the two devices is particularly low cost and simple to manufacture with respect to the prior art hinge devices.

Moreover, in case of need for maintenance or replacement, it is sufficient to disassemble the plate P and remove the piston device 1 from the seat S. Where possible, these operations can also be carried out without dismounting the closure element D from the support W, which greatly simplifies the maintenance of the hinge device H.

The invention is susceptible to many changes and variants. All particulars may be replaced by other technically equivalent elements, and the materials may be different according to the needs, without exceeding the scope of the invention defined by the appended claims.

What is claimed is:

1. A system for controlled rotatable movement of a closing element anchored to a stationary support structure comprising:

a piston device; and a hinge device;

wherein the hinge device includes:

a fixed element anchorable to the stationary support structure; and a movable element anchorable to the closing element;

wherein the movable element and the fixed element are reciprocally coupled to allow a rotation of the movable element between an open position and a closed position, one of the movable element or the fixed element including a hinge body having at least one seat for removably inserting the piston device, the other one of the movable element or the fixed element including a pivot member having a cam element with at least one substantially flat operative surface facing the at least one seat to interact with the piston device; and wherein the piston device includes:

a tubular body removably insertable into the at least one seat of the hinge device having a front portion facing the at least one substantially flat operative surface of the hinge device and a rear portion including a bottom wall, the tubular body including an operating chamber defining a first longitudinal axis, the tubular body enclosing a working fluid;

an actuating head external to the tubular body including a substantially flat front pushing face configured to contact and engage the at least one substantially flat operative surface of the hinge device; and a plunger member slidably movable in the operating chamber between a retracted end position and an extended end position for separating therein at least one first and one second variable volume compartments in fluid communication with each other;

wherein the actuating head is unitarily connected with the plunger member to move along the first axis between a position proximal to the front portion of the tubular body, corresponding to the retracted end position of the plunger member, and a position distal thereto, corresponding to the extended end position of the plunger member;

wherein the operating chamber further includes an elastic contrast member acting on the plunger member for returning thereof from the retracted end position to the extended end position, the operating chamber further including the working fluid acting on the plunger member to hydraulically counteract an action thereof, the elastic contrast member being configured to move between a position of maximum and minimum elongation respectively corresponding to the distal and proximal positions of the actuating head;

wherein the at least one seat of the hinge body includes a pass-through or blind bore extending along a second axis for providing access into the hinge body in a direction substantially parallel to or coinciding with the first axis, the pivot member of the hinge device having an elongated shape to define a third axis substantially perpendicular to the second axis; and wherein the at least one substantially flat operative surface of the pivot member is substantially parallel to the third axis, the at least one substantially flat operative surface of the pivot member and the substantially flat front pushing face of the actuating head being substantially parallel to each other when the actuating head is in the distal position and substantially perpendicular each other when the actuating head is in the proximal position.

2. The system according to claim 1, wherein the hinge device further comprises an abutment member within the bore adapted to abut against the tubular body of the piston device during insertion thereof in the at least one seat.

3. The system according to claim 2, wherein the abutment member is adapted to abut against the bottom wall of the tubular body of the piston device.

4. The system according to claim 3, wherein the bore is a blind bore which includes an opening facing the pivot member and an end wall opposite thereto, the abutment member including an end wall of the bore.

5. The system according to claim 3, wherein the bore is a pass-through bore, the abutment member being a pin substantially transversely inserted within the bore.

6. The system according to claim 5, wherein the pin extends along a fourth axis substantially parallel to the third axis of the pivot member.

7. The system according to claim 1, wherein the first and second variable volume compartments are adjacent to each other.

8. The system according to claim 1, wherein the elastic contrast member is placed in the first compartment so that the first and second variable volume compartments have respectively maximum and minimum volume in correspondence of the distal position of the actuating head and respectively the minimum and maximum volume in correspondence of the proximal position thereof.

9. The system according to claim 1, wherein the plunger member is inserted into the operating chamber so as to define therewith an interspace for passage of the working fluid between the first and second variable volume compartments.

10. The system according to claim 9, wherein the first and second compartments are in fluid communication with each other only through the interspace.

11. The system according to the claim 9, wherein the plunger member includes a one-way valve for controlling a passage of the working fluid between the first and second variable volume compartments upon moving the actuating head from one of the proximal or distal positions towards the other one of the proximal or distal positions, the interspace allowing the passage of the working fluid between the first and second variable volume compartments upon moving back the actuating head from the other one of the proximal or distal positions towards the one of the proximal or distal positions.

12. The system according to the claim 11, wherein the one-way valve is configured to open upon the moving of the actuating head from the proximal position towards the distal position, thus allowing the passage of the working fluid from the second variable volume compartment to the first variable volume compartment, and to close upon the moving of the actuating head from the distal position towards the proximal position, so as to force the passage of working fluid from the first variable volume compartment to the second variable volume compartment through the interspace.

13. The system according to claim 11, wherein the one-way valve is configured to open upon the moving of the actuating head from the distal position towards the proximal position, thus allowing the passage of the working fluid from the first variable volume compartment to the second variable volume compartment, and to close upon the moving of the actuating head from the proximal position towards the distal position, so as to force the passage of working fluid from the second variable volume compartment to the first variable volume compartment through the interspace.

14. The system according to claim 13, wherein the distal position of the actuating head corresponds to the closed position of the movable element of the hinge device, the proximal position of the actuating head corresponding to the open position of the movable element of the hinge device.

15. The system according to claim 13, wherein the distal position of the actuating head corresponds to the open position of the movable element of the hinge device, the proximal position of the actuating head corresponding to the closed position of the movable element of the hinge device.

16. The system according to claim 11, further including a rod telescopically coupled with the front portion of the tubular body and having a first end within the operating chamber unitarily coupled with the plunger member, and a second end external to the operating chamber including the actuating head.

17. The system according to claim 16, wherein the actuating head includes a biasing element removably couplable with the second end of the rod, the biasing element including the front pushing face.

18. The system according to claim 16, wherein the plunger member includes a tubular element with a rear portion coupled with the elastic contrast member and a front portion coupled with the first end of the rod.

19. The system according to claim 18, wherein the front portion of the plunger member is coupled with the first end of the rod to define a housing for the one-way valve which is in fluid communication with both the first and the second variable volume compartments.

20. The system according to claim 1, wherein the at least one operative surface of the pivot member and the front pushing face of the actuating head are mutually mechanically disconnected.

* * * * *